US011898216B2

(12) United States Patent
Kamitani et al.

(10) Patent No.: US 11,898,216 B2
(45) Date of Patent: Feb. 13, 2024

(54) SEAMLESS STEEL PIPE HEAT-TREATMENT-FINISHING-TREATMENT CONTINUOUS FACILITY

(71) Applicant: NIPPON STEEL CORPORATION, Tokyo (JP)

(72) Inventors: Hiroki Kamitani, Tokyo (JP); Takanori Tanaka, Tokyo (JP); Atsushi Soma, Tokyo (JP); Keiichi Kondo, Tokyo (JP); Hideki Mitsunari, Tokyo (JP); Seiya Okada, Tokyo (JP); Takuya Matsumoto, Tokyo (JP); Shinji Yoshida, Tokyo (JP); Yuji Arai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 425 days.

(21) Appl. No.: 16/981,435

(22) PCT Filed: Mar. 26, 2019

(86) PCT No.: PCT/JP2019/012820
§ 371 (c)(1),
(2) Date: Sep. 16, 2020

(87) PCT Pub. No.: WO2019/189158
PCT Pub. Date: Oct. 3, 2019

(65) Prior Publication Data

US 2021/0025021 A1 Jan. 28, 2021

(30) Foreign Application Priority Data

Mar. 28, 2018 (JP) ..... 2018-062481

(51) Int. Cl.
*C21D 9/08* (2006.01)
*B21D 41/04* (2006.01)
*C21D 8/10* (2006.01)

(52) U.S. Cl.
CPC ..... *C21D 9/085* (2013.01); *B21D 41/04* (2013.01); *C21D 8/105* (2013.01)

(58) Field of Classification Search
None
See application file for complete search history.

(56) References Cited

U.S. PATENT DOCUMENTS 4,421,575 A * 12/1983 Murata ..... C21D 9/085 148/590
4,452,061 A 6/1984 Numano et al.
2021/0025021 A1* 1/2021 Kamitani ..... C21D 9/08

FOREIGN PATENT DOCUMENTS

CN 102534375 A 7/2012
CN 103276297 B 2/2016
(Continued)

*Primary Examiner* — Scott R Kastler
(74) *Attorney, Agent, or Firm* — Greer, Burns & Crain, Ltd.

(57) ABSTRACT

A seamless steel pipe heat-treatment-finishing-treatment continuous facility includes: a heat treatment apparatus; a steel pipe inspection apparatus which performs a test for a surface defect and/or an inner defect of the seamless steel pipe, the steel pipe inspection apparatus being disposed downstream of the heat treatment apparatus; a main transfer mechanism which forms a main transfer path MT for transferring the seamless steel pipe, discharged from the heat treatment apparatus, to the steel pipe inspection apparatus disposed downstream of the heat treatment apparatus; and a first forced steel pipe-temperature reduction apparatus which forcibly reduces a temperature of the seamless steel pipe on the main transfer path MT, the first forced steel pipe-temperature reduction apparatus being disposed on the
(Continued)

main transfer path MT at a position downstream of the heat treatment apparatus and upstream of the steel pipe inspection apparatus.

13 Claims, 9 Drawing Sheets

(56) References Cited

FOREIGN PATENT DOCUMENTS

| | | | |
|---|---|---|---|
| EP | 2551026 | A1 | 1/2013 |
| GB | 2199519 | A | 7/1988 |
| JP | 56108829 | A | 8/1981 |
| JP | 57188619 | A | 11/1982 |
| JP | 03110012 | A | 5/1991 |
| WO | 2011118681 | A1 | 9/2011 |

* cited by examiner

SEAMLESS STEEL PIPE HEAT-TREATMENT-FINISHING-TREATMENT CONTINUOUS FACILITY

This is a National Phase Application filed under 35 U.S.C. § 371, of International Application No. PCT/JP2019/012820, filed Mar. 26, 2019, the contents of which are incorporated by reference.

TECHNICAL FIELD

The present invention relates to a facility which performs heat treatment and finishing treatment on a seamless steel pipe, and more particularly to a seamless steel pipe heat-treatment-finishing-treatment continuous facility which can continuously perform a heat treatment step and a finishing treatment step on a seamless steel pipe.

BACKGROUND ART

Facilities for producing a seamless steel pipe include a pipe-producing line facility, a heat treatment facility, a finishing treatment line facility and the like.

In the case where a pipe-producing line facility is a facility which produces seamless steel pipes, the pipe-producing line facility includes, in the order from the upstream side to the downstream side, a piercing mill, an elongating mill, such as a mandrel mill, and a sizing mill, such as a sizer or a reducer, for example. Further, transfer mechanisms (transfer tables or the like) for transferring round billets or hollow shells are provided between respective apparatuses. A round billet is piercing-rolled by the piercing mill so as to produce a hollow shell. The produced hollow shell is elongated by the elongating mill. Further, diameter adjusting rolling performed on the elongated hollow shell by the sizing mill, thus producing a seamless steel pipe having a final outer diameter and wall thickness.

The heat treatment facility is a facility which performs heat treatment on a seamless steel pipe produced by the pipe-producing line facility. The heat treatment may be quenching, tempering, annealing or the like, for example. The heat treatment facility includes a heat apparatus, such as a heat treatment furnace.

The finishing treatment line facility performs finishing treatment on the seamless steel pipe on which heat treatment is performed. The finishing treatment line facility includes, in the order from the upstream side to the downstream side, a pipe-bending straightening apparatus and a pipe inspection apparatus, for example. In the finishing treatment, bending in the seamless steel pipe, on which heat treatment is performed, is straightened using the pipe-bending straightening apparatus when necessary. Further, a test for surface defects and/or inner defects is performed on the seamless steel pipe using the pipe inspection apparatus. The pipe inspection apparatus may be an ultrasonic inspection apparatus, a magnetic inspection apparatus, a penetrant inspection apparatus, an eddy current inspection apparatus, a radiation inspection apparatus or the like, for example.

Conventionally, a heat treatment apparatus in a heat treatment facility and a finishing treatment line facility are not directly connected with each other via a transfer mechanism, such as a transfer table. In other words, the heat treatment apparatus is disposed in a so-called off-line manner with respect to the finishing treatment line facility. Accordingly, for example, a seamless steel pipe on which heat treatment is performed in the heat treatment facility is temporarily stored at a temporary storage location and, after a lapse of a predetermined period of time, the seamless steel pipe is carried out from the temporary storage location, and is supplied to the finishing treatment line facility.

However, in the case of the so-called off-line arrangement where a heat treatment apparatus is not directly connected to a finishing treatment line facility, it is difficult to shorten the production period (lead time) of a seamless steel pipe. Further, in the case Where the heat treatment apparatus is not directly connected to the finishing treatment line facility, it is necessary to manage history information (traceability) of seamless steel pipes which are carried out from the heat treatment and are stored at the temporary storage location. This is because when finishing treatment is to be started on a steel pipe which is once stored at the temporary storage location, it is necessary to find the storage location of a seamless steel pipe on which finishing treatment is desirably performed using history information. Directly connecting the heat treatment apparatus to the finishing treatment line facility allows the management of such traceability to be simplified.

WO 2011/118681 (Patent Literature 1) proposes a steel pipe production facility where a heat treatment apparatus is directly connected to a finishing treatment line facility.

CITATION LIST

Patent Literature

[Patent Literature 1] WO 2011/118681

SUMMARY OF INVENTION

Technical Problem

In the case Where a heat treatment apparatus and a finishing treatment line facility are directly connected with each other via a transfer mechanism, heat treatment and finishing treatment can be continuously performed and hence, it is possible to shorten the production period (lead time) of a steel pipe. However, directly connecting the heat treatment apparatus and the finishing treatment line facility with each other via the transfer mechanisms tends to increase the size of the layout of the factory facility.

It is an objective of this disclosure to provide a seamless steel pipe heat-treatment-finishing-treatment continuous facility which can suppress an increase in size of the layout of a facility even when a heat treatment apparatus and a finishing treatment line facility for a seamless steel pipe are directly connected with each other.

Solution to Problem

The seamless steel pipe heat-treatment-finishing-treatment continuous facility according to this disclosure includes: a heat treatment apparatus, a steel pipe inspection apparatus, a main transfer mechanism, and a first forced steel pipe-temperature reduction apparatus. The heat treatment apparatus allows a seamless steel pipe to be inserted therein, and can perform heat treatment on the seamless steel pipe inserted into the heat treatment apparatus. The steel pipe inspection apparatus is disposed downstream of the heat treatment apparatus, and performs a test for a surface defect and/or an inner defect of the seamless steel pipe which is discharged and transferred from the heat treatment apparatus. The main transfer mechanism forms a main transfer path for transferring the seamless steel pipe, which is discharged from the heat treatment apparatus, to the steel pipe inspection apparatus disposed downstream of the heat treatment apparatus, and the main transfer mechanism includes a plurality of transfer members for transferring the seamless steel pipe. The first forced steel pipe-temperature reduction apparatus is disposed on the main transfer path at a position downstream of the heat treatment apparatus, and upstream of the steel pipe inspection apparatus, and the first forced steel pipe-temperature reduction apparatus forcibly reduces a temperature of the seamless steel pipe on the main transfer path.

Advantageous Effects of Invention

The seamless steel pipe heat-treatment-finishing-treatment continuous facility according to this disclosure can suppress an increase in size of the layout of the facility even when the heat treatment apparatus and the finishing treatment line facility for a seamless steel pipe are directly connected with each other.

DESCRIPTION OF EMBODIMENTS

Figure 1:
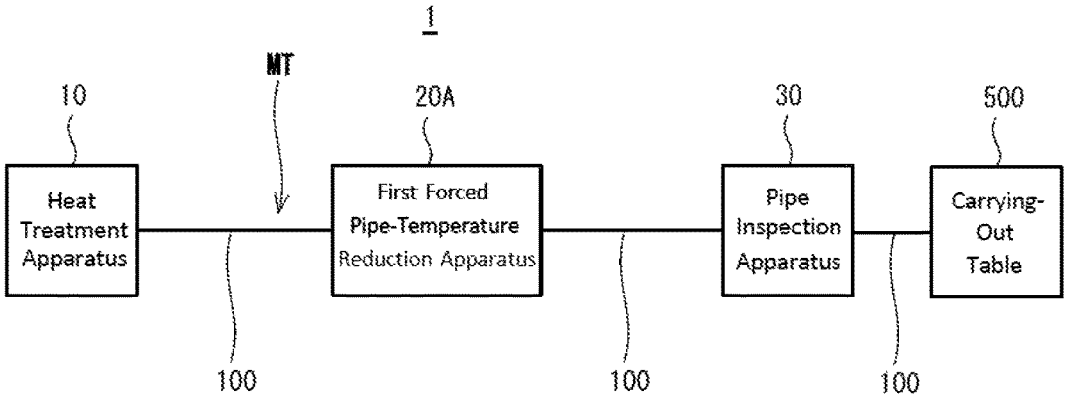
FIG. 1 is a function block diagram showing a facility line of a seamless steel pipe heat-treatment-finishing-treatment continuous facility according to a first embodiment.

Inventors of the present invention firstly conducted studies regarding the layout of the facility where a finishing treatment line facility is disposed downstream of a heat treatment apparatus for a seamless steel pipe, and the heat treatment apparatus and the finishing treatment line facility are joined with each other by a transfer mechanism. As a result, the inventors of the present invention considered that reducing the length of a transfer path, which is formed of the transfer mechanism, and extends from the heat treatment apparatus to the finishing treatment line facility, can suppress an increase in size of the layout of the facility.

However, it is also found that reducing the length of the transfer path, which connects the heat treatment apparatus and the finishing treatment Fine facility, newly causes the following problems.

In the heat treatment apparatus, a seamless steel pipe is held at a predetermined temperature (temperature of heat treatment). For example, in the case where the heat treatment apparatus is a tempering apparatus, there may be a case where the temperature of heat treatment is lower than an $A_{C1}$ transformation point and 500° C. or more depending on the kind of steel, size, and wall thickness of the seamless steel pipe. Accordingly, a seamless steel pipe immediately after being discharged from the heat treatment apparatus is in a high temperature state.

On the other hand, the steel pipe-bending straightening apparatus of the finishing treatment line facility is capable of performing hot straightening in many cases. However, some facilities of the finishing treatment line facility are provided for seamless steel pipes having a normal temperature. For example, a steel pipe inspection apparatus, such as an ultrasonic inspection apparatus and a magnetic inspection apparatus, a chamfering apparatus which chamfers the end face of a steel pipe, a steel pipe cutting machine and the like are provided for seamless steel pipes having a temperature ranging from a normal temperature to approximately 100° C.

Assume a case where a seamless steel pipe in a high temperature state is supplied to the finishing treatment line facility. In such a case, a probe or the like of the steel pipe inspection apparatus may be damaged. Accordingly, in the case Where the heat treatment apparatus is connected to the finishing treatment line facility via the transfer mechanism, it is necessary to sufficiently reduce the temperature of the seamless steel pipe before the seamless steel pipe discharged from the heat treatment apparatus is supplied into the finishing treatment line facility.

Increasing the length of the transfer path, which connects the heat treatment apparatus and the finishing treatment line facility with each other, allows the temperature of the seamless steel pipe to be sufficiently reduced before the seamless steel pipe discharged from the heat treatment apparatus is supplied into the finishing treatment line facility. In this case, however, the layout of the facility increases in size.

In view of the above, the inventors of the present invention conducted studies regarding the layout of a facility where the steel pipe inspection apparatus is not easily affected by heat from a steel pipe while the length of the transfer path is suppressed from the heat treatment apparatus to the finishing treatment line facility, particularly, from the heat treatment apparatus to the steel pipe inspection apparatus. Where the degree of influence by heat is large. As a result, the inventors of the present invention have found the following. The forced steel pipe-temperature reduction apparatus, such as a water cooling apparatus, which forcibly reduces the temperature of the steel pipe, is disposed on the transfer path which connects the heat treatment apparatus and the steel pipe inspection apparatus in the finishing treatment line facility with each other. With such a configuration, while the length of the transfer path from the heat treatment apparatus to the steel pipe inspection apparatus is suppressed, the temperature of the seamless steel pipe can be sufficiently reduced before the seamless steel pipe discharged from the heat treatment apparatus is supplied to the steel pipe inspection apparatus.

In the case where the water cooling apparatus is used as the forced steel pipe-temperature reduction apparatus, the temperature of the seamless steel pipe is locally reduced at a part of the overall length of seamless steel pipe and hence, bending may occur in the seamless steel pipe. Accordingly, usually, from a viewpoint of suppressing the occurrence of bending in the seamless steel pipe, it may be considered that it is not preferable to forcibly reduce the temperature of the seamless steel pipe, discharged from the heat treatment apparatus, using the forced steel pipe-temperature reduction apparatus.

However, the inventors of the present invention found the following. When the temperature of the seamless steel pipe in a high temperature state is forcibly reduced by the forced steel pipe-temperature reduction apparatus, bending easily occurs in a light-wall steel pipe having a wall thickness of less than 10.0 mm. On the other hand, when the temperature of a heavy-wall steel pipe having a wall thickness of 10.0 mm or more is forcibly reduced, bending does not occur as in the case of the light-wall steel pipe having a wall thickness of less than 10.0 mm, or bending minimally occurs in the heavy-wall steel pipe having a wall thickness of 10.0 mm or more.

In the case of a light-wall steel pipe, the temperature of the steel pipe is rapidly reduced when the steel pipe is allowed to cool in the air. Accordingly, the inventors of the present invention found the following. Even in a case where, in the layout of the facility, the forced steel pipe-temperature reduction apparatus is disposed between the heat treatment apparatus and the steel pipe inspection apparatus, the forced steel pipe-temperature reduction apparatus is used such that the forced steel pipe-temperature reduction apparatus is prevented from working on the light-wall steel pipe, or the temperature reduction rate of the seamless steel pipe is suppressed compared with a temperature reduction rate of the heavy-wall steel pipe. With such a usage, the above-mentioned configuration can be sufficiently used even in the case where heavy-wall steel pipes and light-wall steel pipes flow through the same facility line.

The seamless steel pipe heat-treatment-finishing-treatment continuous facility according to this embodiment which is completed based on the above-mentioned technical concept has the following configurations.

(1) A seamless steel pipe heat-treatment-finishing-treatment continuous facility includes a heat treatment apparatus, a steel pipe inspection apparatus, a main transfer mechanism, and a first forced steel pipe-temperature reduction apparatus. The heat treatment apparatus allows a seamless steel pipe to be inserted therein, and can perform heat treatment on the seamless steel pipe inserted into the heat treatment apparatus. The steel pipe inspection apparatus is disposed downstream of the heat treatment apparatus, and performs a test for a surface defect and/or an inner defect of the seamless steel pipe discharged and transferred from the heat treatment apparatus. The main transfer mechanism forms a main transfer path for transferring the seamless steel pipe, which is discharged from the heat treatment apparatus, to the steel pipe inspection apparatus disposed downstream of the heat treatment apparatus, and the main transfer mechanism includes a plurality of transfer members for transferring the seamless steel pipe. The first forced steel pipe-temperature reduction apparatus is disposed on the main transfer path at a position downstream of the heat treatment apparatus, and upstream of the steel pipe inspection apparatus, and forcibly reduces a temperature of the seamless steel pipe on the main transfer path.

In this embodiment, a seamless steel pipe is different from a welded steel pipe having a weld zone, and means a steel pipe having no weld zone. A seamless steel pipe has a circular shape in cross section which is perpendicular to the longitudinal direction.

(2) The seamless steel pipe heat-treatment-finishing-treatment continuous facility having the configuration described in (1) may further include a steel pipe-bending straightening apparatus. In this case, the steel pipe-bending straightening apparatus is disposed on the main transfer path at a position downstream of the heat treatment apparatus, and upstream of the first forced steel pipe-temperature reduction apparatus, and the steel pipe-bending straightening apparatus straightens bending in the seamless steel pipe.

(3) The seamless steel pipe heat-treatment-finishing-treatment continuous facility having the configuration described in (1) may further include a steel pipe-bending straightening apparatus. In this case, the steel pipe-bending straightening apparatus is disposed on the main transfer path at a position downstream of the first forced steel pipe-temperature reduction apparatus, and upstream of the steel pipe inspection apparatus, and the steel pipe-bending straightening apparatus straightens bending in the seamless steel pipe.

(4) The seamless steel pipe heat-treatment-finishing-treatment continuous facility having the configuration described in (2) may further include a second forced steel pipe-temperature reduction apparatus. In this case, the second forced steel pipe-temperature reduction apparatus is disposed on the main transfer path at a position downstream of the heat treatment apparatus, and upstream of the steel pipe-bending straightening apparatus, and the second forced steel pipe-temperature reduction apparatus forcibly reduces a temperature of the seamless steel pipe on the main transfer path.

(5) The seamless steel pipe heat-treatment-finishing-treatment continuous facility having the configuration described in (2) may further include a sub-transfer mechanism and a second forced steel pipe-temperature reduction apparatus. In this case, the sub-transfer mechanism is disposed at a position downstream of the heat treatment apparatus and upstream of the steel pipe-bending straightening apparatus, is connected to the heat treatment apparatus or to the main transfer mechanism, forms a sub-transfer path which is a transfer path different from the main transfer path, and includes a plurality of transfer members for transferring the seamless steel pipe. The second forced steel pipe-temperature reduction apparatus is disposed on the sub-transfer path, and the second forced steel pipe-temperature reduction apparatus forcibly reduces a temperature of the seamless steel pipe on the sub-transfer path.

(6) In the seamless steel pipe heat-treatment-finishing-treatment continuous facility having the configuration described in (5), the sub-transfer mechanism may be connected to the main transfer mechanism. In this case, the sub-transfer path is formed by branching from the main transfer path, and the sub-transfer mechanism transfers, through the sub-transfer path, the seamless steel pipe transferred through the main transfer path.

(7) In the seamless steel pipe heat-treatment-finishing-treatment continuous facility having the configuration described in (5), the sub-transfer mechanism may be connected to the heat treatment apparatus. In this case, the sub-transfer mechanism transfers, through the sub-transfer path, the seamless steel pipe which is discharged from the heat treatment apparatus but which is not transferred to the main transfer path.

(8) The seamless steel pipe heat-treatment-finishing-treatment continuous facility having the configuration described in any one of (2) to (7) may further include a sizing mill. In this case, the sizing mill is disposed on the main transfer path at a position upstream or downstream of and adjacent to the steel pipe-bending straightening apparatus.

Hereinafter, the seamless steel pipe heat-treatment-finishing-treatment continuous facility according to this embodiment is described in detail. Hereinafter, configurations identical or similar to each other are given the same characters in the drawings, and the repeated description of such configurations is omitted.

First Embodiment

FIG. 1 is a function block diagram showing a facility line of a seamless steel pipe heat-treatment-finishing-treatment continuous facility according to this embodiment.

A seamless steel pipe heat-treatment-finishing-treatment continuous facility 1 is a facility line which can continuously perform heat treatment and finishing treatment on a seamless steel pipe. In this embodiment, the applications of the seamless steel pipe are not particularly limited. The seamless steel pipe may be used for oil wells or gas wells (hereinafter, oil wells and gas wells are collectively referred to as "oil wells" in this specification), or may be used as a mechanical structure component such as an automobile component. Further, the kind of steel of a seamless steel pipe is not also particularly limited.

Referring to FIG. 1, the seamless steel pipe heat-treatment-finishing-treatment continuous facility 1 according to this embodiment includes a heat treatment apparatus 10 and a steel pipe inspection apparatus 30 in the order from the upstream side to the downstream side along the facility line.

The heat treatment apparatus 10 allows a seamless steel pipe to be inserted therein, and performs heat treatment on the seamless steel pipe inserted into the heat treatment apparatus 10. The heat treatment apparatus 10 can perform tempering. Further, the heat treatment apparatus 10 may perform annealing. However, the heat treatment apparatus 10 in this specification is not provided for perforating quenching.

The heat treatment apparatus 10 may be a combustion furnace which heats a seamless steel pipe by burning fuel, such as heavy oil or a gas, or may be an electric heat treatment furnace which heats a seamless steel pipe by electricity, for example. The electric heat treatment furnace may be a high-frequency induction heating apparatus, a resistance heating apparatus or the like, for example. Further, a heat treatment apparatus may be of a batch type, or of a continuous type. A continuous heat treatment furnace may be a rotary hearth heat treatment furnace, for example.

The steel pipe inspection apparatus 30 performs a test for surface defects (outer surface flaws and inner surface flaws)/inner defects on a seamless steel pipe. The steel pipe inspection apparatus 30 may be, for example, an ultrasonic inspection apparatus, a magnetic inspection apparatus, a penetrant inspection apparatus, an eddy current inspection apparatus, a radiation inspection apparatus or the like. The magnetic inspection apparatus may be, for example, a leakage magnetic flux inspection apparatus, a magnetic particle inspection apparatus or the like.

The steel pipe inspection apparatus 30 is provided for testing a seamless steel pipe having a normal temperature for surface defects and/or inner defects. Accordingly, if a test is performed on a seamless steel pipe of a temperature more than 100° C., a malfunction may occur in a member forming a part of the steel pipe inspection apparatus 30, or accuracy of the test may be reduced. For this reason, it is preferable that a seamless steel pipe supplied to the steel pipe inspection apparatus 30 has a surface temperature of 100° C. or less.

Main transfer mechanisms 100 form a main transfer path from the heat treatment apparatus 10 to the steel pipe inspection apparatus 30 disposed downstream of the heat treatment apparatus 10. The main transfer mechanisms 100 transfer a seamless steel pipe on which heat treatment is performed to the steel pipe inspection apparatus 30 through the main transfer path MT. The main transfer mechanism 100 includes a plurality of transfer members for transferring a seamless steel pipe through the main transfer path MT. The plurality of transfer members may be a plurality of transfer rollers arranged from the upstream side to the downstream side, for example.

The plurality of transfer members of the main transfer mechanism 100 are not limited to the plurality of transfer rollers arranged from the upstream side to the downstream side of the seamless steel pipe heat-treatment-finishing-treatment continuous facility 1. The plurality of transfer members of the main transfer mechanism 100 may be, for example, a plurality of transfer chains or a plurality of walking beams which can transfer a seamless steel pipe from the upstream side to the downstream side of the seamless steel pipe heat-treatment-finishing-treatment continuous facility 1. Further, the plurality of transfer members of the main transfer mechanism 100 may be formed of another mechanism other than the rollers, the chains or the walking beams, and may transfer a seamless steel pipe from the upstream side to the downstream side of the seamless steel pipe heat-treatment-finishing-treatment continuous facility 1. At least a portion of the plurality of transfer members is disposed below a seamless steel pipe to be transferred, for example. The plurality of transfer members transfer the seamless steel pipe in the downstream direction while coming into contact with the lower portion of the seamless steel pipe to be transferred.

As shown in FIG. 1, the seamless steel pipe heat-treatment-finishing-treatment continuous facility 1 further includes a carrying-out table 500 at a position downstream of the steel pipe inspection apparatus 30. The carrying-out table 500 is, via the main transfer mechanism 1000 connected to the steel pipe inspection apparatus 30 disposed upstream of the carrying-out table 500. In other words, the carrying-out table 500 is disposed on the main transfer path MT. The carrying-out table 500 is a table for temporarily storing a seamless steel pipe, on which a test is performed by the steel pipe inspection apparatus 30, before the seamless steel pipe is moved to another location. The seamless steel pipe which is temporarily stored on the carrying-out table 500 is carried out from the carrying-out table 500 by a crane or the like, for example, and is transferred to another temporary storage location, such as a rack, or to another facility line other than the seamless steel pipe heat-treatment-finishing-treatment continuous facility 1. In FIG. 1, another facility (another finishing apparatus other than the steel pipe inspection apparatus 30, for example) may be disposed on the main transfer path MT at a position between the steel pipe inspection apparatus 30 and the carrying-out table 500.

Referring to FIG. 1, the seamless steel pipe heat-treatment-finishing-treatment continuous facility 1 further includes a first forced steel pipe-temperature reduction apparatus 20A. The first (breed steel pipe-temperature reduction apparatus 20A is disposed on the main transfer path MT at a position downstream of the heat treatment apparatus 10 and upstream of the steel pipe inspection apparatus 30. In other words, the first forced steel pipe-temperature reduction apparatus 20A is, via the main transfer mechanism 100, connected to the heat treatment apparatus 10 disposed upstream of the first forced steel pipe-temperature reduction apparatus 20A, and the first forced steel pipe-temperature reduction apparatus 20A is, via the main transfer mechanism 100, also connected to the steel pipe inspection apparatus 30 disposed downstream of the first forced steel pipe-temperature reduction apparatus 20A.

The first forced steel pipe-temperature reduction apparatus 20A forcibly reduces the temperature of a seamless steel pipe discharged from the heat treatment apparatus 10. In this embodiment, "forcibly reduces the temperature of a seamless steel pipe" means to reduce the temperature of a seamless steel pipe at a cooling rate higher than the cooling rate of cooling in the air.

The configuration of the first forced steel pipe-temperature reduction apparatus 20A is not particularly limited provided that the first forced steel pipe-temperature reduction apparatus 20A can forcibly reduce the temperature of a seamless steel pipe discharged from the heat treatment apparatus 10. The first forced steel pipe-temperature reduction apparatus 20A forcibly reduces the temperature of a seamless steel pipe by causing cooling fluid to be brought into contact with the outer surface and/or the inner surface of the seamless steel pipe.

For example, the first forced steel pipe-temperature reduction apparatus 20A includes a forced temperature-reduction mechanism which forcibly reduces the temperature of a seamless steel pipe using cooling fluid. The cooling fluid may be cooling liquid, such as water or oil, a cooling gas, such as air or an inert gas, mixed fluid of cooling liquid and a cooling gas, or the like, for example. One kind or two or more kinds of cooling liquid may be used in the forced temperature-reduction mechanism. One kind or two or more kinds of cooling gas may be used in the forced temperature-reduction mechanism. It is preferable that the forced temperature-reduction mechanism sprays water onto the surface (outer surface and/or inner surface) of a seamless steel pipe. In other words, the first forced steel pipe-temperature reduction apparatus 20A is preferably a water cooling apparatus. In the case where the first forced steel pipe-temperature reduction apparatus 20A is a water cooling apparatus, the average cooling rate of a seamless steel pipe is 4 to 100° C./sec, for example.

Alternatively, the first forced steel pipe-temperature reduction apparatus 20A may not include the above-mentioned forced temperature-reduction mechanism, which sprays cooling fluid onto the outer surface and/or the inner surface of a seamless steel pipe, but may include a bath in which cooling fluid is stored. In this case, the first forced steel pipe-temperature reduction apparatus 20A forcibly reduces the temperature of a seamless steel pipe by immersing the seamless steel pipe into the cooling fluid in the bath.

The first forced steel pipe-temperature reduction apparatus 20A may include the above-mentioned bath and the above-mentioned forced temperature-reduction mechanism. The configuration of the first forced steel pipe-temperature reduction apparatus 20A is not particularly limited provided that the first forced steel pipe-temperature reduction apparatus 20A can forcibly reduce the temperature of a seamless steel pipe by causing cooling fluid to be brought into contact with the outer surface and/or the inner surface of the seamless steel pipe.

In the seamless steel pipe heat-treatment-finishing-treatment continuous facility 1 of this embodiment, the heat treatment apparatus 10 and the steel pipe inspection apparatus 30, which is included in a finishing treatment line facility, are connected with each other via the main transfer mechanisms 100. In other words, unlike the conventional layout of a factory facility where a heat treatment apparatus 10 and a finishing treatment line facility are arranged in an off-line manner, the heat treatment apparatus 10 and the finishing treatment line facility are arranged in an on-line manner. Accordingly, compared with the case of the off-line arrangement, a seamless steel pipe discharged from the heat treatment apparatus 10 can be rapidly transferred to the steel pipe inspection apparatus 30, thus shortening the production period (the lead time) of the seamless steel pipe.

In the case where the heat treatment apparatus 10 and the steel pipe inspection apparatus 30 are connected with each other via the main transfer mechanism 100, a seamless steel pipe discharged from the heat treatment apparatus 10 is supplied to the steel pipe inspection apparatus 30 with the seamless steel pipe maintaining a high temperature. In this case, a malfunction may occur in a part of the steel pipe inspection apparatus 30 due to heat from the seamless steel pipe, or accuracy of the test may be reduced.

In view of the above, in the seamless steel pipe heat-treatment-finishing-treatment continuous facility 1 of this embodiment, the first forced steel pipe-temperature reduction apparatus 20A is disposed on the main transfer path MT at a position between the heat treatment apparatus 10 and the pipe inspection apparatus 30. In this case, the temperature of a seamless steel pipe discharged from the heat treatment apparatus 10 is forcibly reduced by the first forced steel pipe-temperature reduction apparatus 20A at a position upstream of the steel pipe inspection apparatus 30. Accordingly, compared with a case where the first forced steel pipe-temperature reduction apparatus 20A is not provided, it is possible to remarkably reduce the temperature of a seamless steel pipe supplied to the steel pipe inspection apparatus 30. As a result, it is possible to reduce the length of the main transfer path MT from the heat treatment apparatus 10 to the steel pipe inspection apparatus 30. Accordingly, an increase in size of the layout of the facility can be suppressed, thus allowing the facility to have a compact size.

The seamless steel pipe heat-treatment-finishing-treatment continuous facility 1 is particularly suitable for performing heat treatment and finishing treatment on a heavy-wall steel pipe having a wall thickness of 10.0 mm or more among seamless steel pipes. When the first forced steel pipe-temperature reduction apparatus 20A is applied for a seamless steel pipe having a light wall thickness of less than 10.0 mm, there may be a case where the temperature of the seamless steel pipe is locally reduced at a part of the entire steel pipe so that the seamless steel pipe is bent. On the other hand, in the case where the first forced steel pipe-temperature reduction apparatus 20A is applied for a heavy-wall steel pipe having a wall thickness of 10.0 mm or more, bending does not easily occur even if cooling liquid of the first forced steel pipe-temperature reduction apparatus 20A is water. Accordingly, the above-mentioned seamless steel pipe heat-treatment-finishing-treatment continuous facility 1 is particularly suitable for performing heat treatment and finishing treatment on a heavy-wall steel pipe having a wall thickness of 10.0 mm or more, and more preferably suitable fix performing heat treatment and finishing treatment on a heavy-wall steel pipe having a wall thickness of 15.0 mm or more. However, in the case where cooling capacity of the first forced steel pipe-temperature reduction apparatus 20A is adjusted by changing cooling fluid of the first forced steel pipe-temperature reduction apparatus 20A to cooling gas or mixed fluid, the seamless steel pipe heat-treatment-finishing-treatment continuous facility 1 of this embodiment can be also applied for a light-wall steel pipe having a wall thickness of less than 10.0 mm.

[Method for Producing Seamless Steel Pipe Using Seamless Steel Pipe Heat-Treatment-Finishing-Treatment Continuous Facility 1]

A method for producing a seamless steel pipe using the seamless steel pipe heat-treatment-finishing-treatment continuous facility 1 is as follows. First, a seamless steel pipe is inserted into the heat treatment apparatus 10 so as to perform heat treatment on the seamless steel pipe. The heat treatment may be tempering or annealing, for example. It is preferable to perform tempering in the heat treatment apparatus 10. In this case, the temperature of the heat treatment in the heat treatment apparatus 10 is lower than an $A_{C1}$ transformation point. In the case where the heat treatment apparatus 10 performs tempering, the temperature of the heat treatment is at least 500° C. or more, for example, and is more preferably 600° C. or more.

The seamless steel pipe held at the temperature of the heat treatment for a predetermined time is discharged from the heat treatment apparatus 10. The discharged seamless steel pipe is transferred downstream along a main transfer path MT using the main transfer mechanism 100.

The seamless steel pipe on which heat treatment is performed is supplied to the first forced steel pipe-temperature reduction apparatus 20A by the main transfer mechanism 100. In the first forced steel pipe-temperature reduction apparatus 20A, cooling fluid is brought into contact with the surface of the seamless steel pipe so as to forcibly reduce the temperature of the seamless steel pipe over the overall length of the steel pipe. For example, assume a case where the first forced steel pipe-temperature reduction apparatus 20A includes a forced temperature-reduction mechanism which sprays cooling fluid onto the outer surface and/or the inner surface of a seamless steel pipe. In such a case, the first forced steel pipe-temperature reduction apparatus 20A may forcibly reduce the temperature of the seamless steel pipe such that, after transferring of the steel pipe by the main transfer mechanism 100 is temporarily stopped, the forced temperature-reduction mechanism sprays cooling fluid onto the entire seamless steel pipe. Alternatively, the temperature of the seamless steel pipe may be forcibly reduced such that the forced temperature-reduction mechanism continuously sprays cooling fluid onto the surface of the seamless steel pipe under transfer while the steel pipe is transferred from the upstream side to the downstream side by the main transfer mechanism 100.

Further, the first forced steel pipe-temperature reduction apparatus 20A may forcibly reduce the temperature of a seamless steel pipe such that, after transferring of the seamless steel pipe is temporarily stopped, cooling fluid is sprayed not only onto the outer surface of the seamless steel pipe but also onto the inner surface of the seamless steel pipe, thus forcibly reducing the temperature of the seamless steel pipe from the outer surface and the inner surface of the seamless steel pipe.

In the case where the first forced steel pipe-temperature reduction apparatus 20A includes a bath which stores cooling fluid, the first forced steel pipe-temperature reduction apparatus 20A may forcibly reduce the temperature of a seamless steel pipe by immersing the seamless steel pipe into the cooling fluid in the bath. In the case where the first forced steel pipe-temperature reduction apparatus 20A includes the forced temperature-reduction mechanism and the bath, the first forced steel pipe-temperature reduction apparatus 20A may forcibly reduce the temperature of a seamless steel pipe such that cooling fluid is sprayed onto the outer surface and/or the inner surface of the seamless steel pipe while the seamless steel pipe is immersed into the cooling fluid in the bath.

A processing time in the first forced steel pipe-temperature reduction apparatus 20A and a forced temperature-reduction capacity of the first forced steel pipe-temperature reduction apparatus 20A can be suitably set corresponding to the outer diameter, wall thickness, and kind of steel of a seamless steel pipe. For example, in the case where a seamless steel pipe is a heavy-wall steel pipe having a wall thickness of 10.0 mm or more, the first forced steel pipe-temperature reduction apparatus 20A may forcibly reduce the temperature of the seamless steel pipe using water as cooling fluid. Further, in the case where a seamless steel pipe has a large outer diameter and a large wall thickness, it is sufficient to set a processing time in the first forced steel pipe-temperature reduction apparatus 20A to a suitably long time compared with a case where a seamless steel pipe has a small outer diameter or has a small wall thickness.

The seamless steel pipe where the temperature thereof is forcibly reduced by the first forced steel pipe-temperature reduction apparatus 20A is transferred downstream along the main transfer path MT using the main transfer mechanism 100 so as to supply the seamless steel pipe to the steel pipe inspection apparatus 30. In this case, the steel pipe inspection apparatus 30 can perform a test for surface defects and/or inner defects of the seamless steel pipe where the temperature thereof is forcibly reduced. Accordingly, it is possible to suppress malfunctions in a member forming the steel pipe inspection apparatus 30 and suppress a reduction in accuracy of the test attributable to an extremely high temperature of the seamless steel pipe.

A seamless steel pipe on which a test is performed by the steel pipe inspection apparatus 30 is transferred to the carrying-out table 500, disposed downstream of the steel pipe inspection apparatus 30, and is temporarily stored on the carrying-out table 500. The seamless steel pipe temporarily stored on the carrying-out table 500 is carried out from the carrying-out table 500 to another facility or the like by a crane or the like for example.

Depending on the size, wall thickness, and kind of steel of the seamless steel pipe, the temperature of the seamless steel pipe may be, after the seamless steel pipe is discharged from the heat treatment apparatus 10, reduced to a temperature at which the steel pipe inspection apparatus 30 can perform an inspection on the seamless steel pipe without using the first forced steel pipe-temperature reduction apparatus 20A before the seamless steel pipe reaches the steel pipe inspection apparatus 30. The first forced steel pipe-temperature reduction apparatus 20A may not be applied for such a seamless steel pipe. In this case, it is sufficient to perform the following. The seamless steel pipe discharged from the heat treatment apparatus 10 is transferred to the first forced steel pipe-temperature reduction apparatus 20A by the main transfer mechanism 100. Thereafter, the seamless steel pipe is made to pass through the first forced steel pipe-temperature reduction apparatus 20A from the upstream side to the downstream side without treatment being performed on the seamless steel pipe in the first forced steel pipe-temperature reduction apparatus 20A.

Second Embodiment

Figure 2:
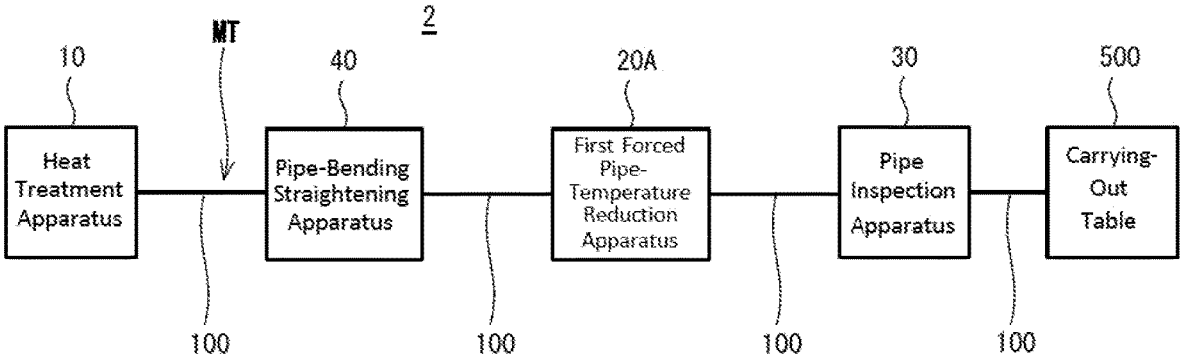
FIG. 2 is a function block diagram showing a facility line of a seamless steel pipe heat-treatment-finishing-treatment continuous facility according to a second embodiment.

FIG. 2 is a function block diagram showing a facility line of a seamless steel pipe heat-treatment-finishing-treatment continuous facility according to a second embodiment.

Referring to FIG. 2, a seamless steel pipe heat-treatment-finishing-treatment continuous facility 2 according to the second embodiment additionally includes a steel pipe-bending straightening apparatus 40 compared with the seamless steel pipe heat-treatment-finishing-treatment continuous facility 1.

The steel pipe-bending straightening apparatus 40 includes a plurality of pairs of straightening rollers which are arranged from the upstream side to the downstream side of the seamless steel pipe heat-treatment-finishing-treatment continuous facility 2, for example. Each straightening roller pair includes an upper straightening roller and a lower straightening roller. The upper straightening roller is disposed above the pass line (a line along which the center axis of a seamless steel pipe moves) of a main transfer path MT. The lower straightening roller is disposed below the pass line of the main transfer path MT. The steel pipe-bending straightening apparatus 40 causes a seamless steel pipe to pass through the plurality of pairs of straightening rollers so as to straighten the seamless steel pipe. With such operations, bending in the seamless steel pipe is straightened so that the roundness or the straightness of the seamless steel pipe increases.

In the seamless steel pipe heat-treatment-finishing-treatment continuous facility 2 of this embodiment, the steel pipe-bending straightening apparatus 40 is disposed on the main transfer path MT at a position downstream of a heat treatment apparatus 10 and upstream of a first forced steel pipe-temperature reduction apparatus 20A. Other configurations are substantially equal to the corresponding configurations of the seamless steel pipe heat-treatment-finishing-treatment continuous facility 1 of the first embodiment.

To be more specific, the seamless steel pipe heat-treatment-finishing-treatment continuous facility 2 includes, in addition to the steel pipe-bending straightening apparatus 40, the heat treatment apparatus 10, the first forced steel pipe-temperature reduction apparatus 20A, and a steel pipe inspection apparatus 30 in the order from the upstream side to the downstream side along a facility line. The configurations of the heat treatment apparatus 10, the first forced steel pipe-temperature reduction apparatus 20A, and the steel pipe inspection apparatus 30 are substantially equal to the corresponding configurations in the first embodiment.

In the seamless steel pipe heat-treatment-finishing-treatment continuous facility 2, the main transfer path MT is formed of main transfer mechanisms 100 from the heat treatment apparatus 10 to the steel pipe inspection apparatus 30 in the same manner as the seamless steel pipe heat-treatment-finishing-treatment continuous facility 1. The heat treatment apparatus 10 is, via the main transfer mechanism 100, connected to the steel pipe-bending straightening apparatus 40 disposed downstream of the heat treatment apparatus 10. The steel pipe-bending straightening apparatus 40 is, via the main transfer mechanism 100, connected to the first forced steel pipe-temperature reduction apparatus 20A disposed downstream of the steel pipe-bending straightening apparatus 40. The first forced steel pipe-temperature reduction apparatus 20A is, via the main transfer mechanism 100, connected to the steel pipe inspection apparatus 30 disposed downstream of the first forced steel pipe-temperature reduction apparatus 20A.

There may be a case where bending is present in a seamless steel pipe discharged from the heat treatment apparatus 10. For example, in the case where heat treatment is performed on a seamless steel pipe by the heat treatment apparatus 10, bending may occur in the seamless steel pipe due to the heat treatment depending on the kind of heat treatment, the size (outer diameter, wall thickness) of the seamless steel pipe, and the kind of steel. There may be also a case where bending is already present in a seamless steel pipe before the seamless steel pipe is inserted into the heat treatment apparatus 10. For example, in the case where tempering is performed in the heat treatment apparatus 10, bending may occur in a seamless steel pipe in performing quenching which is a step performed before tempering is performed. In this case, a seamless steel pipe in which bending is already present is inserted into the heat treatment apparatus 10.

In the case where bending is present in a seamless steel pipe discharged from the heat treatment apparatus 10, bending in the seamless steel pipe is straightened by the steel pipe-bending straightening apparatus 40.

The steel pipe-bending straightening apparatus 40 can perform straightening (hot straightening) in a temperature range near the temperature of heat treatment. Accordingly, in the seamless steel pipe heat-treatment-finishing-treatment continuous facility 2, hot straightening is performed, by the steel pipe-bending straightening apparatus 40, on a seamless steel pipe discharged from the heat treatment apparatus 10 when necessary. In the seamless steel pipe heat-treatment-finishing-treatment continuous facility 2, the seamless steel pipe on which hot straightening is performed is further transferred to the first forced steel pipe-temperature reduction apparatus 20A by the main transfer mechanism 100, and the temperature of the seamless steel pipe is forcibly reduced by the first forced steel pipe-temperature reduction apparatus 20A. Accordingly, even when the length of the main transfer path MT is reduced (even when the layout of the facility is made compact), the temperature of the seamless steel pipe supplied to the steel pipe inspection apparatus 30 can be reduced. Accordingly, it is possible to suppress malfunctions in the steel pipe inspection apparatus 30 and suppress a reduction in accuracy of the test attributable to the high temperature of a seamless steel pipe.

Particularly With regard to oil well-seamless steel pipes used as oil country tubular goods among seamless steel pipes, sulfide stress cracking resistance (SSC resistance) is reduced if strain remains in a seamless steel pipe. Accordingly, if cold straightening is performed on an oil well-seamless steel pipe for sour environment which is required to have excellent SSC resistance, strain remains in the seamless steel pipe and hence, SSC resistance is reduced. In this embodiment, hot straightening is performed, using the steel pipe-bending straightening apparatus 40, on the seamless steel pipe discharged from the heat treatment apparatus 10. In the case where hot straightening is performed, strain which is generated due to performing straightening is less likely to remain in the seamless steel pipe compared with a case where cold straightening is performed. Accordingly, the layout of the facility in this embodiment is particularly effective for a seamless steel pipe for sour environment (which is required to have excellent SSC resistance).

[Method for Producing Seamless Steel Pipe Using Seamless Steel Pipe Heat-Treatment-Finishing-Treatment Continuous Facility 2]

A method for producing a seamless steel pipe using the seamless steel pipe heat-treatment-finishing-treatment continuous facility 2 is as follows. First, a seamless steel pipe is inserted into a heat treatment apparatus 10 so as to perform heat treatment on the seamless steel pipe. The heat treatment may be tempering or annealing, for example.

The seamless steel pipe held at the temperature of the heat treatment for a predetermined time is discharged from the heat treatment apparatus 10. The discharged seamless steel pipe is transferred downstream along a main transfer path MT using the main transfer mechanism 100.

The seamless steel pipe on which heat treatment is performed is transferred to the steel pipe-bending straightening apparatus 40 by the main transfer mechanism 100. In the steel pipe-bending straightening apparatus 40, hot straightening is performed on the seamless steel pipe. With such straightening, the roundness and the straightness of the seamless steel pipe are increased.

The seamless steel pipe on which hot straightening is performed still has a high temperature. Accordingly, the seamless steel pipe on which hot straightening is performed is transferred to a first forced steel pipe-temperature reduction apparatus 20A by the main transfer mechanism 100. In the first forced steel pipe-temperature reduction apparatus 20A, the temperature of the seamless steel pipe is forcibly reduced by a method substantially equal to the method in the first embodiment.

The seamless steel pipe where the temperature thereof is forcibly reduced by the first forced steel pipe-temperature reduction apparatus 20A is transferred downstream along the main transfer path MT using the main transfer mechanism 100 so as to supply the seamless steel pipe to the steel pipe inspection apparatus 30. In this case, the steel pipe inspection apparatus 30 can perform a test for surface defects and/or inner defects of the seamless steel pipe where the temperature thereof is forcibly reduced. Accordingly, it is possible to suppress malfunctions in a member forming the steel pipe inspection apparatus 30 and suppress a reduction in accuracy of the test attributable to an extremely high temperature of the seamless steel pipe.

Depending on the size, wall thickness, and kind of steel of the seamless steel pipe, there may be no bending in the seamless steel pipe even after the seamless steel pipe is discharged from the heat treatment apparatus 10. The steel pipe-bending straightening apparatus 40 may not be applied for such a seamless steel pipe. In this case, the seamless steel pipe discharged from the heat treatment apparatus 10 is transferred to the steel pipe-bending straightening apparatus 40 by the main transfer mechanism 100. Thereafter, the seamless steel pipe is made to pass through the steel pipe-bending straightening apparatus 40 from the upstream side to the downstream side without straightening being performed on the seamless steel pipe in the steel pipe-bending straightening apparatus 40.

Third Embodiment

Figure 3:
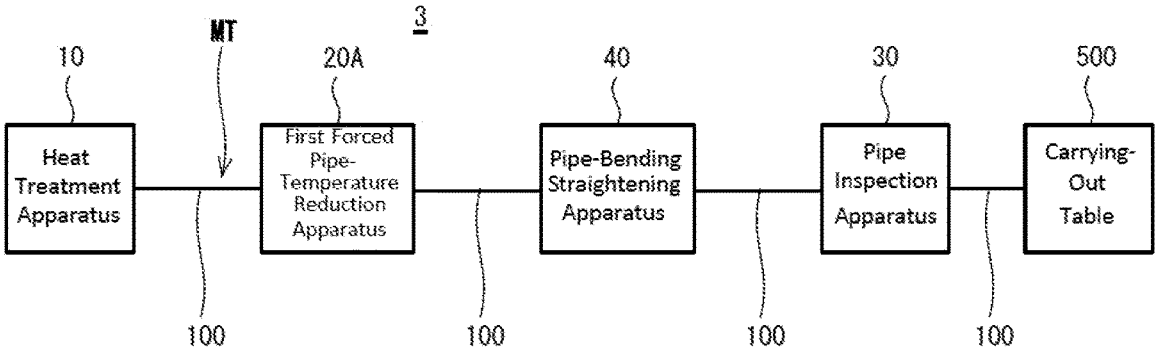
FIG. 3 is a function block diagram showing a facility line of a seamless steel pipe heat-treatment-finishing-treatment continuous facility according to a third embodiment.

FIG. 3 is a function block diagram showing a facility line of a seamless steel pipe heat-treatment-finishing-treatment continuous facility according to a third embodiment.

Referring to FIG. 3, a seamless steel pipe heat-treatment-finishing-treatment continuous facility 3 according to the third embodiment additionally includes a steel pipe-bending straightening apparatus 40 compared with the seamless steel pipe heat-treatment-finishing-treatment continuous facility 1. The configuration of the steel pipe-bending straightening apparatus 40 is substantially equal to the configuration of the steel pipe-bending straightening apparatus 40 of the second embodiment. However, the steel pipe-bending straightening apparatus 40 of this embodiment performs cold straightening.

In the seamless steel pipe heat-treatment-finishing-treatment continuous facility 3 of this embodiment, the steel pipe-bending straightening apparatus 40 is disposed on a main transfer path MT at a position downstream of a first forced steel pipe-temperature reduction apparatus 20A and upstream of a steel pipe inspection apparatus 30. Other configurations are substantially equal to the corresponding configurations of the seamless steel pipe heat-treatment-finishing-treatment continuous facility 1 of the first embodiment. In other words, in the seamless steel pipe heat-treatment-finishing-treatment continuous facility 2 of the second embodiment, the steel pipe-bending straightening apparatus 40 is disposed between the heat treatment apparatus 10 and the first forced steel pipe-temperature reduction apparatus 20A. On the other hand, in the seamless steel pipe heat-treatment-finishing-treatment continuous facility 3 of this embodiment, the steel pipe-bending straightening apparatus 40 is disposed between the first forced steel pipe-temperature reduction apparatus 20A and the steel pipe inspection apparatus 30. The seamless steel pipe heat-treatment-finishing-treatment continuous facility 3 is significantly different from the seamless steel pipe heat-treatment-finishing-treatment continuous facility 2 with respect to such a point.

The seamless steel pipe heat-treatment-finishing-treatment continuous facility 3 includes, in addition to the steel pipe-bending straightening apparatus 40, the heat treatment apparatus 10, the first forced steel pipe-temperature reduction apparatus 20A, and the steel pipe inspection apparatus 30 in the order from the upstream side to the downstream side along a facility line. The configurations of the heat treatment apparatus 10, the first forced steel pipe-temperature reduction apparatus 20A, and the steel pipe inspection apparatus 30 are substantially equal to the corresponding configurations in the first embodiment.

In the seamless steel pipe heat-treatment-finishing-treatment continuous facility 3, the main transfer path MT is formed of main transfer mechanisms 100 from the heat treatment apparatus 10 to the steel pipe inspection apparatus 30 in the same manner as the seamless steel pipe heat-treatment-finishing-treatment continuous facility 1. To be more specific, the heat treatment apparatus 10 is, via the main transfer mechanism 100, connected to the first forced steel pipe-temperature reduction apparatus 20A disposed downstream of the heat treatment apparatus 10. The first forced steel pipe-temperature reduction apparatus 20A is, via the main transfer mechanism 100, connected to the steel pipe-bending straightening apparatus 40 disposed downstream of the first forced steel pipe-temperature reduction apparatus 20A. The steel pipe-bending straightening apparatus 40 is, via the main transfer mechanism 100, connected to the steel pipe inspection apparatus 30 disposed downstream of the steel pipe-bending straightening apparatus 40.

There may be a case where bending is present in a seamless steel pipe discharged from the heat treatment apparatus 10. For example, in the case where heat treatment is performed on a seamless steel pipe, bending may occur in the seamless steel pipe due to the heat treatment depending on the kind of heat treatment, the size (outer diameter, wall thickness) of the seamless steel pipe, and the kind of steel. There may be also a case where bending is already present in a seamless steel pipe before the seamless steel pipe is inserted into the heat treatment apparatus 10. In the case where bending is present in a seamless steel pipe discharged from the heat treatment apparatus 10, bending in the seamless steel pipe is straightened by the steel pipe-bending straightening apparatus 40.

Depending on the kind of steel of the seamless steel pipe, cracks, such as a so-called 475° C. embrittlement, may occur in a seamless Steel pipe when hot straightening is performed on the seamless steel pipe. For example, ferritic stainless steel corresponds to this kind. In the case where bending is present in a seamless steel pipe of this kind of steel, it is more preferable to adopt the configuration where the temperature of the steel pipe is reduced by the first forced steel pipe-temperature reduction apparatus 20A and, thereafter, cold straightening is performed on the steel pipe, than to adopt the configuration where hot straightening is performed on the steel pipe at a position upstream of the first forced steel pipe-temperature reduction apparatus 20A. In the seamless steel pipe heat-treatment-finishing-treatment continuous facility 3 of this embodiment, the steel pipe-bending straightening apparatus 40 is disposed downstream of the first forced steel pipe-temperature reduction apparatus 20A. Accordingly, after the temperature of a seamless steel pipe is forcibly reduced to a temperature sufficiently lower than 475° C. in the first forced steel pipe-temperature reduction apparatus 20A, cold straightening can be performed on the seamless steel pipe in the steel pipe-bending straightening apparatus 40. Accordingly, cold straightening is performed on a seamless steel pipe of a kind of steel, where cracks may occur with hot straightening, so as to straighten bending caused by the heat treatment. Further, it is possible to supply the seamless steel pipe, to the steel pipe inspection apparatus 30, where the temperature of the seamless steel pipe is sufficiently reduced.

[Method for Producing Steel Pipe Using Seamless Steel Pipe Heat-Treatment-Finishing-Treatment Continuous Facility 3]

A method for producing a seamless steel pipe using the seamless steel pipe heat-treatment-finishing-treatment continuous facility 3 is as follows. First, a seamless steel pipe is inserted into a heat treatment apparatus 10 so as to perform heat treatment on the seamless steel pipe. The heat treatment may be tempering or annealing, for example. The seamless steel pipe held at a predetermined temperature of the heat treatment for a predetermined time is discharged from the heat treatment apparatus 10. The discharged seamless steel pipe is transferred downstream along the main transfer path MT using a main transfer mechanism 100.

A seamless steel pipe on which heat treatment is performed has a high temperature. Accordingly, the seamless steel pipe on which heat treatment is performed is transferred to the first forced steel pipe-temperature reduction apparatus 20A by the main transfer mechanism 100. In the first forced steel pipe-temperature reduction apparatus 20A, the temperature of the seamless steel pipe is forcibly reduced by a method substantially equal to the method in the first embodiment.

Subsequently, the seamless steel pipe where the temperature thereof is sufficiently reduced is transferred to the steel pipe-bending straightening apparatus 40 by the main transfer mechanism 100. In the steel pipe-bending straightening apparatus 40, cold straightening is performed on the seamless steel pipe. With such straightening, the roundness and the straightness of the seamless steel pipe are increased.

The temperature of the seamless steel pipe on which cold straightening is performed is sufficiently low. Accordingly, the seamless steel pipe on which cold straightening is performed is transferred downstream along a main transfer path MT using the main transfer mechanism 100 so as to supply the seamless steel pipe to a steel pipe inspection apparatus 30. In this case, the steel pipe inspection apparatus 30 can perform a test for surface defects anchor inner defects of the seamless steel pipe where the temperature thereof is forcibly reduced. Accordingly, it is possible to suppress malfunctions in a member forming the steel pipe inspection apparatus 30 and suppress a reduction in accuracy of the test attributable to an extremely high temperature of the steel pipe.

Depending on the size, wall thickness, and kind of steel of the seamless steel pipe, there may be no bending in a seamless steel pipe after the seamless steel pipe is discharged from the heat treatment apparatus 10. The steel pipe-bending straightening apparatus 40 may not be applied for such a seamless steel pipe. In this case, the seamless steel pipe is transferred to the steel pipe-bending straightening apparatus 40 by the main transfer mechanism 100. Thereafter, the seamless steel pipe is made to pass through the steel pipe-bending straightening apparatus 40 from the upstream side to the downstream side without straightening being performed on the seamless steel pipe in the steel pipe-bending straightening apparatus 40.

Fourth Embodiment

Figure 4:
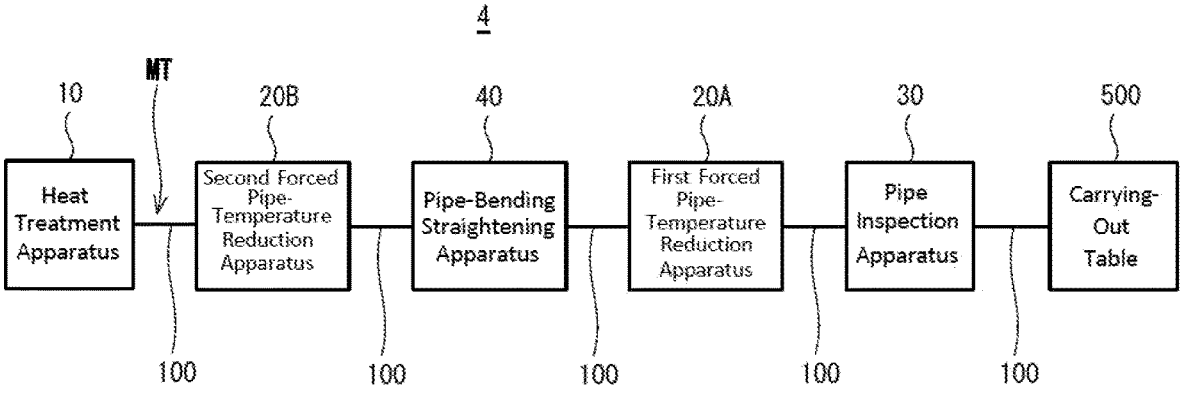
FIG. 4 is a function block diagram showing a facility line of a seamless steel pipe heat-treatment-finishing-treatment continuous facility according to a fourth embodiment.

FIG. 4 is a function block diagram showing a facility line of a, seamless steel pipe heat-treatment-finishing-treatment continuous facility according to a fourth embodiment.

Referring to FIG. 4, a seamless steel pipe heat-treatment-finishing-treatment continuous facility 4 according to the fourth embodiment additionally includes a second forced steel pipe-temperature reduction apparatus 20B compared with the seamless steel pipe heat-treatment-finishing-treatment continuous facility 2 according to the second embodiment (FIG. 2).

The second forced steel pipe-temperature reduction apparatus 20B is disposed on a main transfer path MT at a position downstream of a heat treatment apparatus 10 and upstream of a steel pipe-bending straightening apparatus 40. In other words, the second forced steel pipe-temperature reduction apparatus 20B is, via a main transfer mechanism 100, connected to the heat treatment apparatus 10 disposed upstream of the second forced steel pipe-temperature reduction apparatus 20B. Further, the second forced steel pipe-temperature reduction apparatus 20B is, via a main transfer mechanism 100, also connected to the steel pipe-bending straightening apparatus 40 disposed downstream of the second forced steel pipe-temperature reduction apparatus 20B.

In the same manner as the first forced steel pipe-temperature reduction apparatus 20A, the second forced steel pipe-temperature reduction apparatus 20B forcibly reduces the temperature eta seamless steel pipe.

In the same manner as the first forced steel pipe-temperature reduction apparatus 20A, the configuration of the second forced steel pipe-temperature reduction apparatus 20B is not particularly limited provided that the second forced steel pipe-temperature reduction apparatus 20B can forcibly reduce the temperature of a seamless steel pipe. The second forced steel pipe-temperature reduction apparatus 20B forcibly reduces the temperature of a seamless steel pipe by causing cooling fluid to be brought into contact with the outer surface and/or the inner surface of the seamless steel pipe.

For example, the second forced steel pipe-temperature reduction apparatus 20B includes a forced temperature-reduction mechanism which forcibly reduces the temperature of a seamless steel pipe using cooling fluid. The cooling fluid may be cooling liquid, such as water or oil, a cooling gas, such as air or an inert gas, mixed fluid of cooling liquid and a cooling gas, or the like, for example. One kind or two or more kinds of cooling liquid may be used in the forced temperature-reduction mechanism. One kind or two or more kinds of cooling gas may be used in the forced temperature-reduction mechanism. It is preferable that the forced temperature-reduction mechanism sprays water to the surface (outer surface and/or inner surface) of a steel pipe. In other words, the second forced steel pipe-temperature reduction apparatus 20B is preferably a water cooling apparatus. In the case where the second forced steel pipe-temperature reduction apparatus 20B is a water cooling apparatus, the average cooling rate of a seamless steel pipe is 4 to 100° C./sec, for example.

Alternatively, the second forced steel pipe-temperature reduction apparatus 20B may not include the forced temperature-reduction mechanism which sprays cooling fluid to the outer surface and/or the inner surface of a seamless steel pipe, but may include a bath in which cooling fluid is stored. In this case, the second forced steel pipe-temperature reduction apparatus 20B forcibly reduces the temperature of a seamless steel pipe by immersing the seamless steel pipe into the cooling fluid in the bath.

Further, the second forced steel pipe-temperature reduction apparatus 20B may include the above-mentioned bath and the alcove-mentioned forced temperature-reduction mechanism. The configuration of the second forced steel pipe-temperature reduction apparatus 20B is not particularly limited provided that the second forced steel pipe-temperature reduction apparatus 20B can forcibly reduce the temperature of a seamless steel pipe by causing cooling fluid to be brought into contact with the outer surface and/or the inner surface of the seamless steel pipe.

Other configurations of the seamless steel pipe heat-treatment-finishing-treatment continuous facility 4 of this embodiment are substantially equal to the corresponding configurations of the seamless steel pipe heat-treatment-finishing-treatment continuous facility 2 of the second embodiment. In other words, in the seamless steel pipe heat-treatment-finishing-treatment continuous facility 2 of the second embodiment, one forced steel pipe-temperature reduction apparatus (the first forced steel pipe-temperature reduction apparatus 20A) is disposed at a position downstream of the steel pipe-bending straightening apparatus 40 and upstream of a steel pipe inspection apparatus 30. On the other hand, in the seamless steel pipe heat-treatment-finishing-treatment continuous facility 4 of this embodiment, two forced steel pipe-temperature reduction apparatuses (the first forced steel pipe-temperature reduction apparatus 20A and the second forced steel pipe-temperature reduction apparatus 20B) are disposed, and the second forced steel pipe-temperature reduction apparatus 20B, the steel pipe-bending straightening apparatus 40, and the first forced steel pipe-temperature reduction apparatus 20A are disposed in the order from the upstream side to the downstream side. The seamless steel pipe heat-treatment-finishing-treatment continuous facility 4 is significantly different from the seamless steel pipe heat-treatment-finishing-treatment continuous facility 2 with respect to such a point.

The seamless steel pipe heat-treatment-finishing-treatment continuous facility 4 includes, in addition to the first forced steel pipe-temperature reduction apparatus 20A and the second forced steel pipe-temperature reduction apparatus 20B, the heat treatment apparatus 10, the steel pipe-bending straightening apparatus 40, and the steel pipe inspection apparatus 30 in the order from the upstream side to the downstream side along a facility line. The configurations of the heat treatment apparatus 10, the steel pipe-bending straightening apparatus 40, the first forced steel pipe-temperature reduction apparatus 20A, and the steel pipe inspection apparatus 30 are substantially equal to the corresponding configurations in the second embodiment.

In the seamless steel pipe heat-treatment-finishing-treatment continuous facility 4, in the same manner as the seamless steel pipe heat-treatment-finishing-treatment continuous facility 2, the main transfer path MT is formed of the main transfer mechanisms 100 from the heat treatment apparatus 10 to the steel pipe inspection apparatus 30. To be more specific, the heat treatment apparatus 10 is, via the main transfer mechanism 100, connected to the second forced steel pipe-temperature reduction apparatus 20B disposed downstream of the heat treatment apparatus 10. The second forced steel pipe-temperature reduction apparatus 20B is connected to the steel pipe-bending straightening apparatus 40 via the main transfer mechanism 100. The steel pipe-bending straightening apparatus 40 is, via the main transfer mechanism 100, connected to the first forced steel pipe-temperature reduction apparatus 20A disposed downstream of the steel pipe-bending straightening apparatus 40. The first forced steel pipe-temperature reduction apparatus 20A is, via the main transfer mechanism 100, connected to the steel pipe inspection apparatus 30 disposed downstream of the first forced steel pipe-temperature reduction apparatus 20A.

In the seamless steel pipe heat-treatment-finishing-treatment continuous facility 4 having the above-mentioned configuration, it is possible to select for use either one of the second forced steel pipe-temperature reduction apparatus 20B or the first forced steel pipe-temperature reduction apparatus 20A depending of the kind of steel of a seamless steel pipe. For example, assume the case of oil well-seamless steel pipe which is required to have excellent sour resistance (SSC resistance). When bending occurs in such an oil well-seamless steel pipe during heat treatment, hot straightening is performed in the steel pipe-bending straightening apparatus 40, Accordingly, in this case, the seamless steel pipe discharged from the heat treatment apparatus 10 is transferred to the second forced steel pipe-temperature reduction apparatus 20B by the main transfer mechanism 100. Thereafter, the seamless steel pipe is made to pass through the second forced steel pipe-temperature reduction apparatus 20B from the upstream side to the downstream side without forced temperature-reduction treatment being performed on the seamless steel pipe in the second forced steel pipe-temperature reduction apparatus 20B. Further, the seamless steel pipe is transferred to the steel pipe-bending straightening apparatus 40 without any treatment being performed on the seamless steel pipe. Then, hot straightening is performed on the seamless steel pipe in the steel pipe-bending straightening apparatus 40. The seamless steel pipe on which straightening is performed is transferred to the first forced steel pipe-temperature reduction apparatus 20A by the main transfer mechanism 100. Thereafter, the temperature of the seamless steel pipe is forcibly reduced in the first forced steel pipe-temperature reduction apparatus 20A. In this case, the seamless steel pipe where the temperature thereof is sufficiently reduced by the first forced steel pipe-temperature reduction apparatus 20A can be transferred to the steel pipe inspection apparatus 30. Accordingly, the second forced steel pipe-temperature reduction apparatus 20B is not applied for an oil well-seamless steel pipe for sour environment (which is required to have excellent SSC resistance). Hot straightening is performed on the oil well-seamless steel pipe by the steel pipe-bending straightening apparatus 40 and, thereafter, the temperature of the oil well-seamless steel pipe is forcibly reduced by the first forced steel pipe-temperature reduction apparatus 20A. With such operations, the seamless steel pipe where the temperature thereof is sufficiently reduced can be supplied to the steel pipe inspection apparatus 30 while strain generated due to bending straightening is prevented from remaining in the seamless steel pipe.

On the other hand, assume the case of a seamless steel pipe of a kind of steel where cracks, such as 475° C. embrittlement, may occur with hot straightening. When bending occurs in such a seamless steel pipe during heat treatment, cold straightening is performed in the steel pipe-bending straightening apparatus 40. Accordingly, in this case, the seamless steel pipe discharged from the heat treatment apparatus 10 is transferred to the second forced steel pipe-temperature reduction apparatus 20B. Thereafter, the temperature of the seamless steel pipe is forcibly reduced in the second forced steel pipe-temperature reduction apparatus 20B. The seamless steel pipe where the temperature thereof is forcibly reduced is transferred to the steel pipe-bending straightening apparatus 40. Their cold straightening is performed on the seamless steel pipe in the steel pipe-bending straightening apparatus 40. The seamless steel pipe on which cold straightening is performed is transferred to the first forced steel pipe-temperature reduction apparatus 20A. Thereafter, the seamless steel pipe is made to pass through the first forced steel pipe-temperature reduction apparatus 20A from the upstream side to the downstream side without forced temperature-reduction treatment being performed on the seamless steel pipe in the first forced steel pipe-temperature reduction apparatus 20A. Further, the seamless steel pipe is transferred to the steel pipe inspection apparatus 30 without any treatment being performed on the seamless steel pipe. As described above, with respect to a seamless steel pipe of a kind of steel, where cracks may occur with hot straightening, the temperature of the seamless steel pipe is forcibly reduced by the second forced steel pipe-temperature reduction apparatus 20B and, thereafter, cold straightening is performed on the seamless steel pipe by the steel pipe-bending straightening apparatus 40. With such operations, the seamless steel pipe where the temperature thereof is sufficiently reduced can be supplied to the steel pipe inspection apparatus 30 while the occurrence of cracks caused by straightening is suppressed.

In the case where it is unnecessary to forcibly reduce the temperature of a seamless steel pipe forced temperature-reduction treatment is performed in neither of the first forced steel pipe-temperature reduction apparatus 20A nor the second forced steel pipe-temperature reduction apparatus 20B. In other words, in this case, the seamless steel pipe discharged from the heat treatment apparatus 10 is transferred by the main transfer mechanism 100, and is made to pass through the second forced steel pipe-temperature reduction apparatus 20B without forced temperature-reduction treatment being performed on the seamless steel pipe. Then, bending in the seamless steel pipe is straightened in the steel pipe-bending straightening apparatus 40. The seamless steel pipe where bending is straightened is transferred by the main transfer mechanism 100, and is made to pass through the first forced steel pipe-temperature reduction apparatus 20A without forced temperature-reduction treatment being performed on the seamless steel pipe. Then, a test for surface defects and/or inner defects of a seamless steel pipe is performed in the steel pipe inspection apparatus 30.

Fifth Embodiment

Figure 5A:
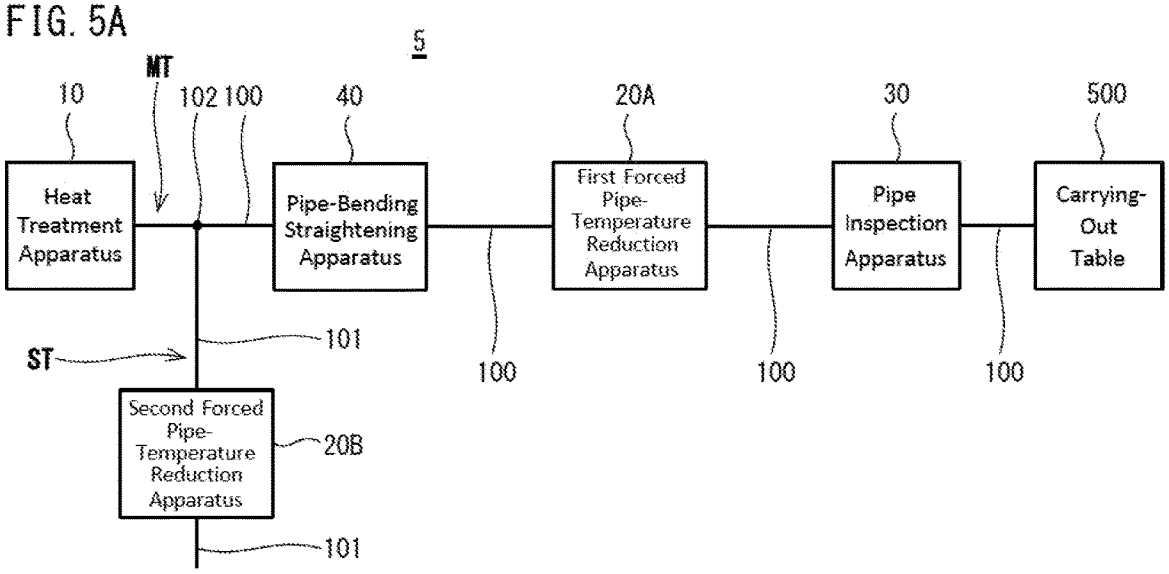
FIG. 5A is a function block diagram showing a facility line of a seamless steel pipe heat-treatment-finishing-treatment continuous facility according to a fifth embodiment.

FIG. 5A is a function block diagram showing a facility line of a seamless steel pipe heat-treatment-finishing-treatment continuous facility according to a fifth embodiment.

Referring to FIG. 5A, a seamless steel pipe heat-treatment-finishing-treatment continuous facility 5 according to the fifth embodiment additionally includes a second forced steel pipe-temperature reduction apparatus 20B and a sub-transfer mechanism 101 compared with the seamless steel pipe heat-treatment-finishing-treatment continuous facility 2 according to the second embodiment (FIG. 2).

The sub-transfer mechanism 101 is connected to a main transfer mechanism 100 between a heat treatment apparatus 10 and a steel pipe-bending straightening apparatus 40 at a branch point 102. The sub-transfer mechanism 101 extends in a direction different from the main transfer mechanism 100. The sub-transfer mechanism 101 forms a sub-transfer path ST which is branched from the main transfer path MT at the branch point 102.

The configuration of the sub-transfer mechanism 101 is substantially equal to the configuration of the main transfer mechanism 100. The sub-transfer mechanism 101 includes a plurality of transfer members arranged from the upstream side toward the downstream side of the seamless steel pipe heat-treatment-finishing-treatment continuous facility 5, for example. The transfer members may be transfer rollers, for example. The transfer members of the sub-transfer mechanism 101 are not limited to the transfer rollers arranged from the upstream side to the downstream side of the seamless steel pipe heat-treatment-finishing-treatment continuous facility 5. The transfer members of the sub-transfer mechanism 101 may be, for example, transfer chains or walking beams which can transfer a steel material from the upstream side to the downstream side of the seamless steel pipe heat-treatment-finishing-treatment continuous facility 5. Further, the sub-transfer mechanism 101 may transfer a steel pipe from the upstream side to the downstream side of the seamless steel pipe heat-treatment-finishing-treatment continuous facility 5 by means of transfer members other than the rollers, the chains, or the walking beams. At least a portion of the plurality of transfer members is disposed below a seamless steel pipe to be transferred, for example. The plurality of transfer members transfer the seamless steel pipe in the downstream direction while coming into contact with the lower portion of the seamless steel pipe to be transferred.

A well-known branching apparatus is disposed at the branch point 102. The branching apparatus transfers, to the sub-transfer path ST, the seamless steel pipe transferred from the upstream side toward the downstream side along the main transfer path MT. The branching apparatus may be a kicker, a pusher or the like, for example.

The second forced steel pipe-temperature reduction apparatus 20B is disposed on the sub-transfer path ST at a position downstream of the heat treatment apparatus 10. In other words, the second forced steel pipe-temperature reduction apparatus 20B is connected to the heat treatment apparatus 10 disposed upstream of the second forced steel pipe-temperature reduction apparatus 20B via the sub-transfer mechanism 101.

In the same manner as the first forced steel pipe-temperature reduction apparatus 20A, the second forced steel pipe-temperature reduction apparatus 20B forcibly reduces the temperature of the seamless steel pipe transferred. The second forced steel pipe-temperature reduction apparatus 20B has the above-mentioned configuration.

Other configurations of the seamless steel pipe heat-treatment-finishing-treatment continuous facility 5 of this embodiment are substantially equal to the corresponding configurations of the seamless steel pipe heat-treatment-finishing-treatment continuous facility 2 of the second embodiment. To be more specific, the seamless steel pipe heat-treatment-finishing-treatment continuous facility 5 includes, in addition to the sub-transfer mechanism 101 and the second forced steel pipe-temperature reduction apparatus 20B, the heat treatment apparatus 10, the steel pipe-bending straightening apparatus 40, a first forced steel pipe-temperature reduction apparatus 20A, and a steel pipe inspection apparatus 30 in the order from the upstream side to the downstream side along a facility line. The configurations of the heat treatment apparatus 10, the steel pipe-bending straightening apparatus 40, the first forced steel pipe-temperature reduction apparatus 20A, and the steel pipe inspection apparatus 30 are substantially equal to the corresponding, configurations in the first embodiment.

In the seamless steel pipe heat-treatment-finishing-treatment continuous facility 5, the main transfer path MT is formed of main transfer mechanisms 100 from the heat treatment apparatus 10 to the steel pipe inspection apparatus 30 in the same manner as the seamless steel pipe heat-treatment-finishing-treatment continuous facility 1. The heat treatment apparatus 10 is, via the main transfer mechanism 100, connected to the steel pipe-bending straightening apparatus 40 disposed downstream of the heat treatment apparatus 10. The steel pipe bending straightening apparatus 40 is, via the main transfer mechanism 100, connected to the first forced steel pipe-temperature reduction apparatus 20A disposed downstream of the steel pipe-bending straightening apparatus 40. The first forced steel pipe-temperature reduction apparatus 20A is, via the main transfer mechanism 100, connected to the steel pipe inspection apparatus 30 disposed downstream of the first forced steel pipe-temperature reduction apparatus 20A.

In the seamless steel pipe heat-treatment-finishing-treatment continuous facility 5 having the above-mentioned configuration, a seamless steel pipe which requires no inspection by the steel pipe inspection apparatus 30, or a seamless steel pipe which requires no straightening by the steel pipe-bending straightening apparatus 40 is, after being, discharged from the heat treatment apparatus 10, transferred not to the main transfer path MT but to the sub-transfer path ST. Then, the temperature of the seamless steel pipe is forcibly reduced by the second forced steel pipe-temperature reduction apparatus 20B when necessary. On the other hand, a seamless steel pipe which requires hot straightening is, after being discharged from the heat treatment apparatus 10, transferred downstream along the main transfer path MT, and is subjected to hot straightening by the steel pipe-bending straightening apparatus 40.

Depending on the size, wall thickness, and kind of steel of the seamless steel pipe, a seamless steel pipe may require an inspection by the steel pipe inspection apparatus 30 although no bending is present in the seamless steel pipe even after the seamless steel pipe is discharged from the heat treatment apparatus 10. In this case, the seamless steel pipe discharged from the heat treatment apparatus 10 is transferred to the steel pipe-bending straightening apparatus 40 by the main transfer mechanism 100. Thereafter, the seamless steel pipe is made to pass through the steel pipe-bending straightening apparatus 40 from the upstream side to the downstream side without straightening being performed on the seamless steel pipe in the steel pipe-bending straightening apparatus 40. Then, the temperature of the seamless steel pipe is forcibly reduced in the first forced steel pipe-temperature reduction apparatus 20A by a method substantially equal to the method in the first embodiment. The seamless steel pipe where the temperature thereof is forcibly reduced by the first forced steel pipe-temperature reduction apparatus 20A is transferred downstream along the main transfer path MT using the main transfer mechanism 100 so as to supply the seamless steel pipe to the steel pipe inspection apparatus 30.

Figure 5B:
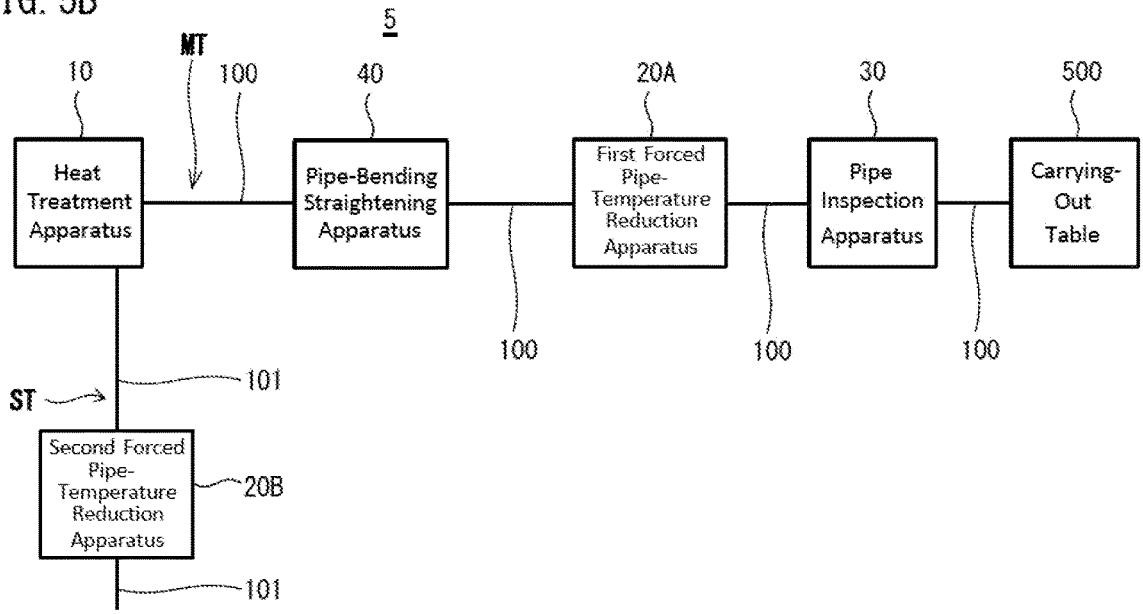
FIG. 5B is a function block diagram showing a facility line of the seamless steel pipe heat-treatment-finishing-treatment continuous facility according to the fifth embodiment which is different from the facility line shown in FIG. 5A.

The seamless steel pipe heat-treatment-finishing-treatment continuous facility 5 according to the fifth embodiment is not limited to the configuration shown in FIG. 5A. FIG. 5B is a function block diagram showing another configuration of the seamless steel pipe heat-treatment-finishing-treatment continuous facility 5 according to the fifth embodiment which is different from the configuration shown in FIG. 5A.

Unlike the configuration shown in FIG. 5A, in the seamless steel pipe heat-treatment-finishing-treatment continuous facility 5 shown in FIG. 5B, the sub-transfer mechanism 101 is not connected to the main transfer mechanism 100, but is connected to the heat treatment apparatus 10.

For example, the heat treatment apparatus 10 has a first discharge port and a second discharge port. The first discharge port allows a seamless steel pipe, which is inserted into the heat treatment apparatus 10, to be discharged therethrough. The second discharge port allows a seamless steel pipe, which is inserted into the heat treatment apparatus 10, to be discharged therethrough, and the second discharge port is different from the first discharge port. The main transfer mechanism 100 is connected to the heat treatment apparatus 10, and transfers a seamless steel pipe discharged from the first discharge port. The sub-transfer mechanism 101 is connected to the heat treatment apparatus 10 at a position which is different from the position where the main transfer mechanism 100 is connected to the heat treatment apparatus 10. The sub-transfer mechanism 101 transfers the seamless steel pipe discharged from the second discharge port. Accordingly, also in this case, the sub-transfer path ST forms a transfer path Which is separated from the main transfer path MT.

In the case of the configuration shown in FIG. 5B, the sub-transfer mechanism 101 transfers, through the sub-transfer path ST, a seamless steel pipe which is discharged from the heat treatment apparatus 10 but which is not transferred to the main transfer path MT. For example, a seamless steel pipe discharged from the first discharge port of the heat treatment apparatus 10 is transferred downstream along the main transfer path MT using the main transfer mechanism 100. On the other hand, a seamless steel pipe discharged from the second discharge port of the heat treatment apparatus 10 is transferred downstream along the sub-transfer path ST using the sub-transfer mechanism 101.

Assume the case where the seamless steel pipe heat-treatment-finishing-treatment continuous facility 5 has the configuration shown in FIG. 5B. Even in such a case, a seamless steel pipe which requires no inspection by the steel pipe inspection apparatus 30 or a seamless steel pipe which requires no straightening by the steel pipe-bending straightening apparatus 40 is discharged from the heat treatment apparatus 10 and, thereafter, the seamless steel pipe can be transferred to the sub-transfer path ST. Then, forced temperature-reduction treatment may be performed on the seamless steel pipe in the second forced steel pipe-temperature reduction apparatus 20B so as to forcibly reduce the temperature of the seamless steel pipe when necessary.

As shown in FIG. 5A and FIG. 5B, in the seamless steel pipe heat-treatment-finishing-treatment continuous facility 5 of the fifth embodiment, the sub-transfer mechanism 101 is disposed at a position downstream of the heat treatment apparatus 10 and upstream of the steel pipe-bending straightening apparatus 40. The sub-transfer mechanism 101 is connected to the heat treatment apparatus 10 or to the main transfer mechanism 100, thus forming the sub-transfer path ST which is a transfer path different from the main transfer path MT. In the case Where the sub-transfer mechanism 101 is connected to the heat treatment apparatus 10, the sub-transfer mechanism 101 transfers, through the sub-transfer path ST, a seamless steel pipe which is discharged from the heat treatment apparatus 10 but which is not transferred to the main transfer path MT. In the case where the sub-transfer mechanism 101 is connected to the main transfer mechanism 100, the sub-transfer mechanism 101 transfers, through the sub-transfer path ST, a seamless steel pipe transferred through the main transfer path MT.

With the above-mentioned configuration, a seamless steel pipe which requires hot straightening is, after being discharged from the heat treatment apparatus 10, transferred downstream along the main transfer path MT so that hot straightening can be performed on the seamless steel pipe by the steel pipe-bending straightening apparatus 40. On the other hand, a seamless steel pipe which requires no hot straightening is, after being discharged from the heat treatment apparatus 10, transferred downstream along the sub-transfer path ST so that the seamless steel pipe can be transferred without passing through the steel pipe-bending straightening apparatus 40.

Depending on the size, wall thickness, and kind of steel of the seamless steel pipe, a seamless steel pipe may require an inspection by the steel pipe inspection apparatus 30 although no bending is present in the seamless steel pipe even after the seamless steel pipe is discharged from the heat treatment apparatus 10. In this case, in the same manner as the configuration shown in FIG. 5A, a seamless steel pipe discharged from the heat treatment apparatus 10 is transferred to the steel pipe-bending straightening apparatus 40 by the main transfer mechanism 100. Thereafter, the seamless steel pipe is made to pass through the steel pipe-bending straightening apparatus 40 from the upstream side to the downstream side without straightening being performed on the seamless steel pipe in the steel pipe-bending straightening apparatus 40. Then, the temperature of the seamless steel pipe is forcibly reduced in the first forced steel pipe-temperature reduction apparatus 20A by a method substantially equal to the method in the first embodiment. The seamless steel pipe where the temperature thereof is forcibly reduced by the first forced steel pipe-temperature reduction apparatus 20A is transferred downstream along the main transfer path MT using the main transfer mechanism 100 so as to supply the seamless steel pipe to the steel pipe inspection apparatus 30.

In the sub-transfer path ST in the fifth embodiment, a facility disposed on the sub-transfer path ST at a position downstream of the second forced steel pipe-temperature reduction apparatus 20B is not particularly limited. For example, a cooling bed or another facility may be disposed on the sub-transfer path ST at a position downstream of the second forced steel pipe-temperature reduction apparatus 20B.

Further, a portion of the sub-transfer path ST disposed downstream of the second forced steel pipe-temperature reduction apparatus 20B may be connected to a portion of the main transfer path MT between the first forced steel pipe-temperature reduction apparatus 20A and the steel pipe inspection apparatus 30. In other words, the portion of the sub-transfer mechanism 101 disposed downstream of the second forced steel pipe-temperature reduction apparatus 20B may be connected to the portion of the main transfer mechanism 100 between the first forced steel pipe-temperature reduction apparatus 20A and the steel pipe inspection apparatus 30. In this case, an inspection can be performed by the steel pipe inspection apparatus 30 in an on-line manner on a seamless steel pipe where the temperature thereof is forcibly reduced by the second forced steel pipe-temperature reduction apparatus 20B through the sub-transfer path ST. For example, a seamless steel pipe which requires no straightening by the steel pipe-bending straightening apparatus 40 is transferred to the sub-transfer path ST so as to forcibly reduce the temperature of the seamless steel pipe by the second forced steel pipe-temperature reduction apparatus 20B and, then, the seamless steel pipe can be supplied to the steel pipe inspection apparatus 30.

Sixth Embodiment

The seamless steel pipe heat-treatment-finishing-treatment continuous facility 2 to 5 of the above mentioned second to fifth embodiment may further include a sizing mill 50 at a position upstream or downstream of and adjacent to the steel pipe-bending straightening apparatus 40.

Figure 6A:
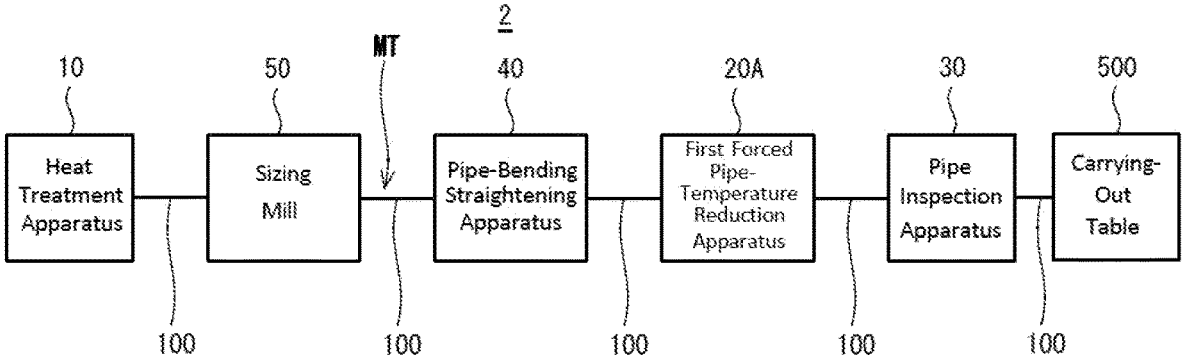
FIG. 6A is a function block diagram showing one example of a facility line of a seamless steel pipe heat-treatment-finishing-treatment continuous facility according to a sixth embodiment.
Figure 6B:
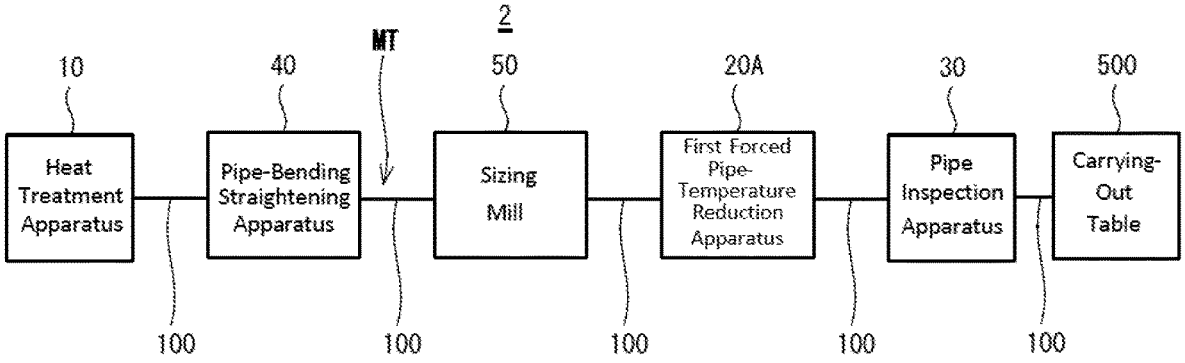
FIG. 6B is a function block diagram showing one example of a facility line of the seamless steel pipe heat-treatment-finishing-treatment continuous facility according to the sixth embodiment which is different from the facility line shown in FIG. 6A.

For example, in the case where the sizing mill 50 is further disposed in the seamless steel pipe heat-treatment-finishing-treatment continuous facility 2 shown in FIG. 2, a pattern shown in FIG. 6A or a pattern shown in FIG. 6B may be considered. In FIG. 6A, the sizing mill 50 is disposed on the main transfer path MT at a position upstream of and adjacent to the steel pipe-bending straightening apparatus 40. In other words, the sizing mill 50 is disposed on the main transfer path MT at a position between the heat treatment apparatus 10 and the steel pipe-bending straightening apparatus 40. In FIG. 6B, the sizing mill 50 is disposed on the main transfer path MT at a position downstream of and adjacent to the steel pipe-bending straightening apparatus 40. In other words, the sizing mill 50 is disposed on the main transfer path MT at a position between the steel pipe-bending straightening apparatus 40 and the first forced steel pipe-temperature reduction apparatus 20A.

The sizing mill 50 performs drawing and rolling on a seamless steel pipe, thus forming a final outer diameter of the seamless steel pipe. The sizing mill 50 may be sizer, a stretch reducer or the like, for example. The sizing mill 50 includes a plurality of roll stands arranged from the upstream side toward the downstream side of the seamless steel pipe heat-treatment-finishing-treatment continuous facility. Each roll stand includes a plurality of rolling rolls arranged equidistantly about a pass line (an axis along which the center axis of a seamless steel pipe passes). A caliber is framed on each rolling roll, and these calibers form a groove.

With respect to the seamless steel pipe on which heat treatment is performed, there may be a case where a part of the seamless steel pipe is deformed due to the influence of heat treatment and, as a result, the outer diameter varies in the longitudinal direction. In view of the above, in this embodiment, the sizing mill 50 is disposed upstream or downstream of the steel pipe-bending, straightening apparatus 40, and the outer diameter of the seamless steel pipe is adjusted by the sizing mill 50.

Figure 6C:
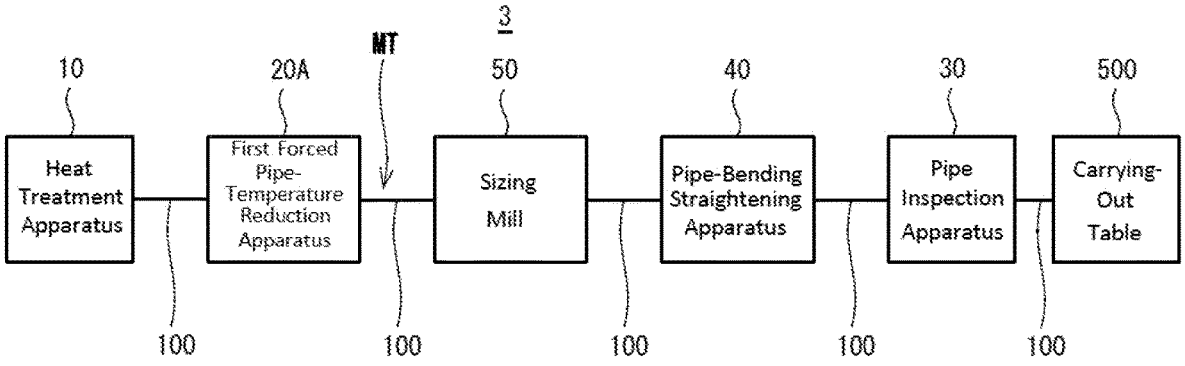
FIG. 6C is a function block diagram showing one example of a facility line of the seamless steel pipe heat-treatment-finishing-treatment continuous facility according to the sixth embodiment which is different from the facility lines shown in FIG. 6A and FIG. 6B.
Figure 6D:
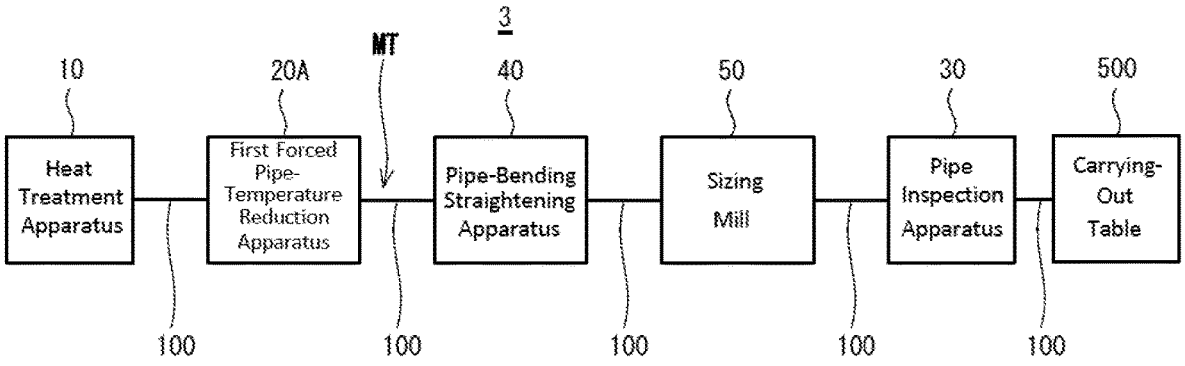
FIG. 6D is a function block diagram showing one example of a facility line of the seamless steel pipe heat-treatment-finishing-treatment continuous facility according to the sixth embodiment which is different from the facility lines shown in FIG. 6A to FIG. 6C.

The arrangement of the sizing null 50 is not limited to the seamless steel pipe heat-treatment-finishing-treatment continuous facility 2 shown in FIG. 2. For example, in the case Where the sizing mill 50 is disposed in the seamless steel pipe heat-treatment-finishing-treatment continuous facility 3 shown in FIG. 3, a pattern shown in FIG. 6C or a pattern shown in FIG. 6D may be considered. In FIG. 6C, the sizing mill 50 is disposed on the main transfer path MT at a position upstream of and adjacent to the steel pipe-bending straightening apparatus 40. In other words, the sizing mill 50 is disposed on the main transfer path MT at a position between the first forced steel pipe-temperature reduction apparatus 20A and the steel pipe-bending straightening apparatus 40. In FIG. 6D, the sizing mill 50 is disposed on the main transfer path MT at a position downstream of and adjacent to the steel pipe-bending straightening apparatus 40. In other words, the sizing mill 50 is disposed on the main transfer path MT at a position between the steel pipe-bending straightening apparatus 40 and the steel pipe inspection apparatus 30.

Figure 6E:
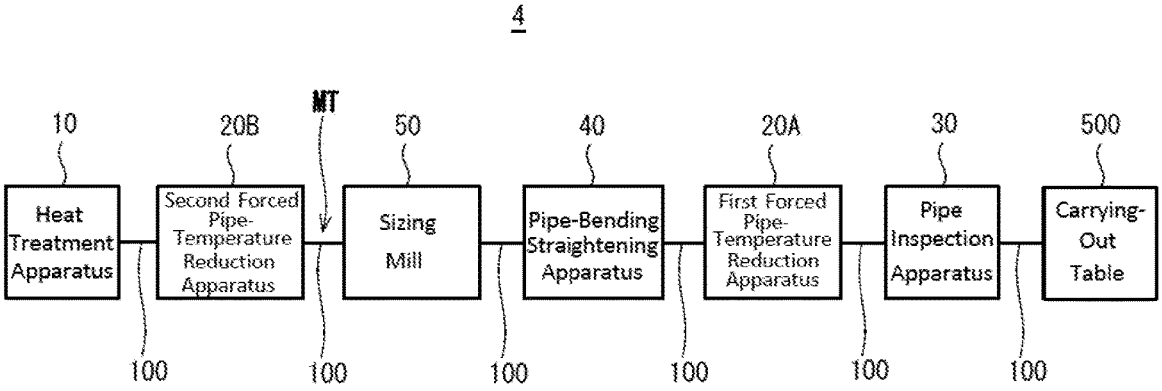
FIG. 6E is a function block diagram showing one example of a facility line of the seamless steel pipe heat-treatment-finishing-treatment continuous facility according to the sixth embodiment which is different from the facility lines shown in FIG. 6A to FIG. 6D.
Figure 6F:
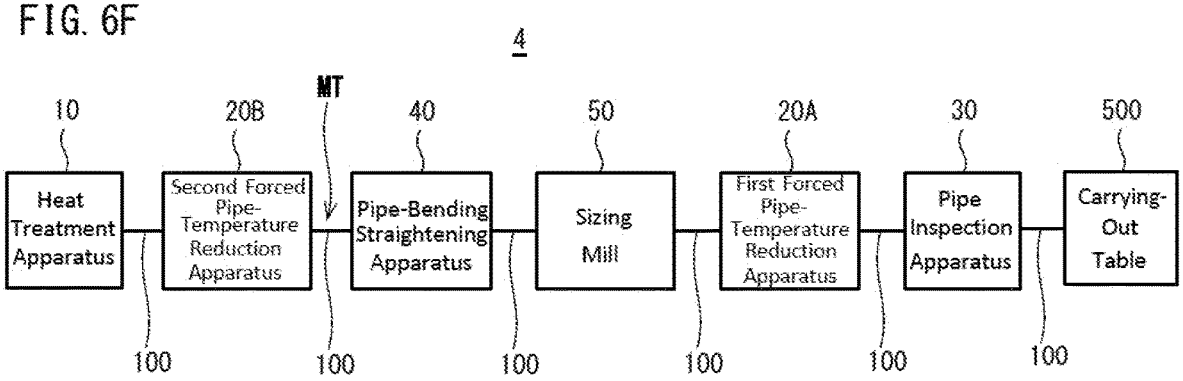
FIG. 6F is a function block diagram showing one example of a facility line of the seamless steel pipe heat-treatment-finishing-treatment continuous facility according to the sixth embodiment which is different from the facility lines shown in FIG. 6A to FIG. 6E.

In the case where the sizing mill 50 is disposed in the seamless steel pipe heat-treatment-finishing-treatment continuous facility 4 shown in FIG. 4, a pattern shown in FIG. 6E or a pattern shown in FIG. 6F may be considered. In FIG. 6E, the sizing mill 50 is disposed on the main transfer path MT at a position upstream of and adjacent to the steel pipe-bending straightening apparatus 40. In other words, the sizing mill 50 is disposed on the main transfer path MT at a position between the second forced steel pipe-temperature reduction apparatus 20B and the steel pipe-bending straightening apparatus 40. In FIG. 6F, the sizing mill 50 is disposed on the main transfer path MT at a position downstream of and adjacent to the steel pipe-bending straightening apparatus 40. In other words, the sizing mill 50 is disposed on the main transfer path MT at a position between the steel pipe-bending straightening apparatus 40 and the first forced steel pipe-temperature reduction apparatus 20A.

Figure 6G:
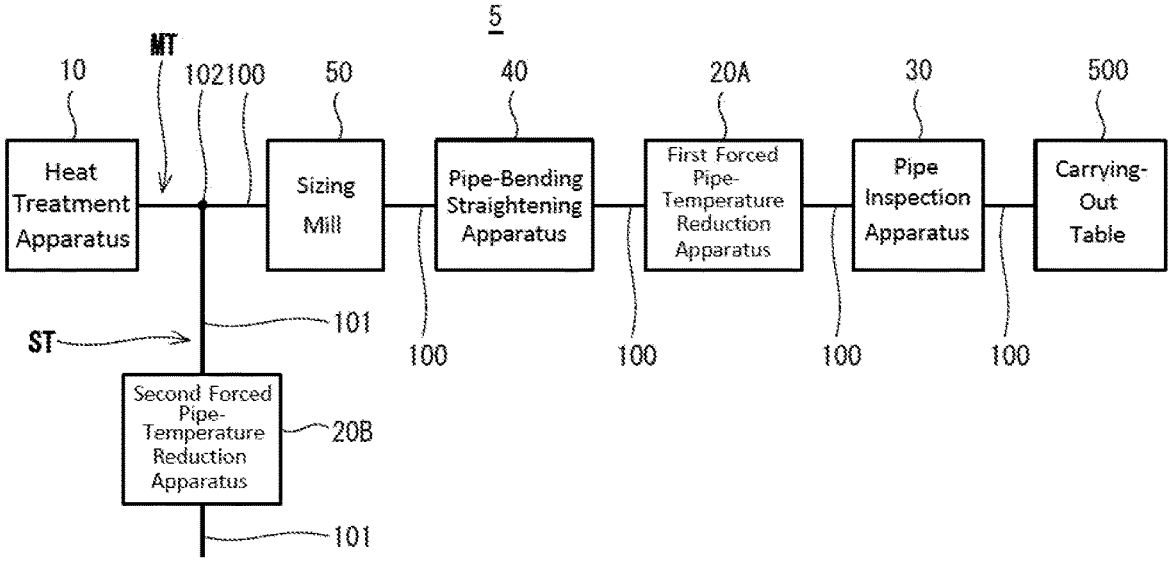
FIG. 6G is a function block diagram showing one example of a facility line of the seamless steel pipe heat-treatment-finishing-treatment continuous facility according to the sixth embodiment which is different from the facility lines shown in FIG. 6A to FIG. 6F.
Figure 6H:
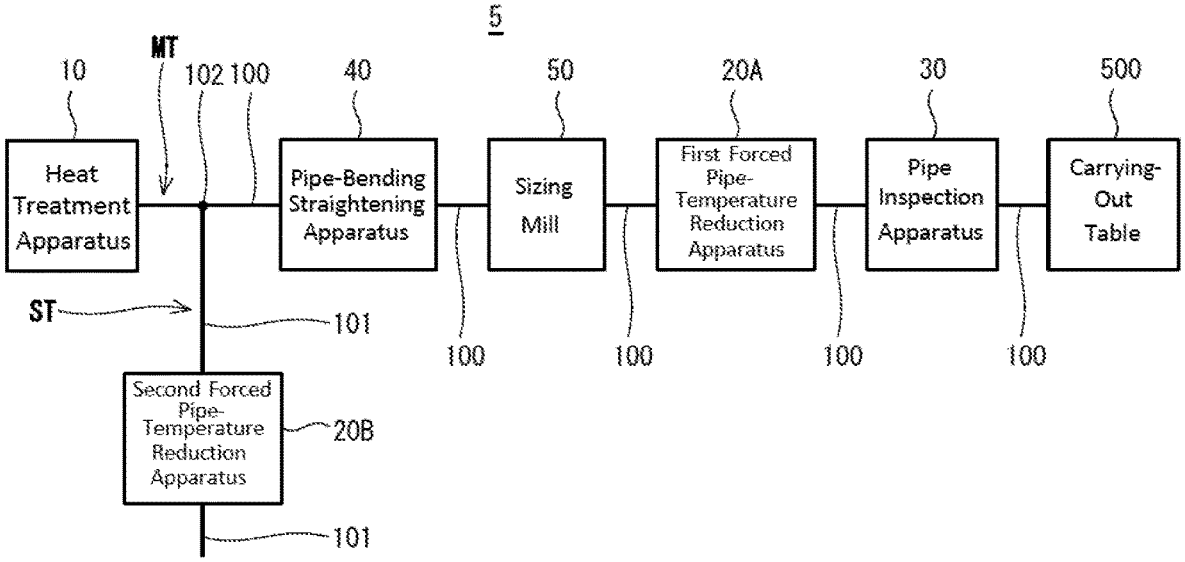
FIG. 6H is a function block diagram showing one example of a facility line of the seamless steel pipe heat-treatment-finishing-treatment continuous facility according to the sixth embodiment which is different from the facility lines shown in FIG. 6A to FIG. 6G.

In the case where the sizing mill 50 is disposed in the seamless steel pipe heat-treatment-finishing-treatment continuous facility 5 shown in FIG. 5A, a pattern shown in FIG. 6G or a pattern shown in FIG. 6H may be considered. In FIG. 6G, the sizing mill 50 is disposed on the main transfer path MT at a position upstream of and adjacent to the steel pipe-bending straightening apparatus 40. In other words, the sizing mill 50 is disposed on the main transfer path MT at a position between the heat treatment apparatus 10 and the steel pipe-bending straightening apparatus 40. In FIG. 6H, the sizing mill 50 is disposed on the main transfer path MT at a position downstream of and adjacent to the steel pipe-bending straightening apparatus 40. In other words, the sizing mill 50 is disposed on the main transfer path MT at a position between the steel pipe-bending straightening apparatus 40 and the first forced steel pipe-temperature reduction apparatus 20A.

Figure 6I:
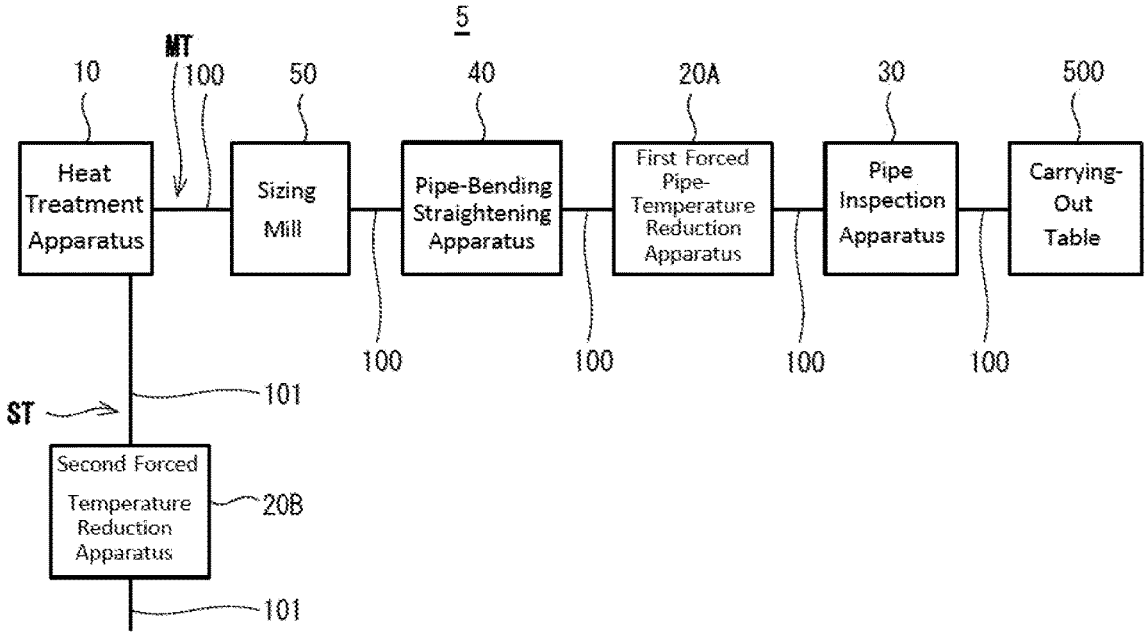
FIG. 6I is a function block diagram showing one example of a facility line of the seamless steel pipe heat-treatment-finishing-treatment continuous facility according to the sixth embodiment which is different from the facility lines shown in FIG. 6A to FIG. 6H.
Figure 6J:
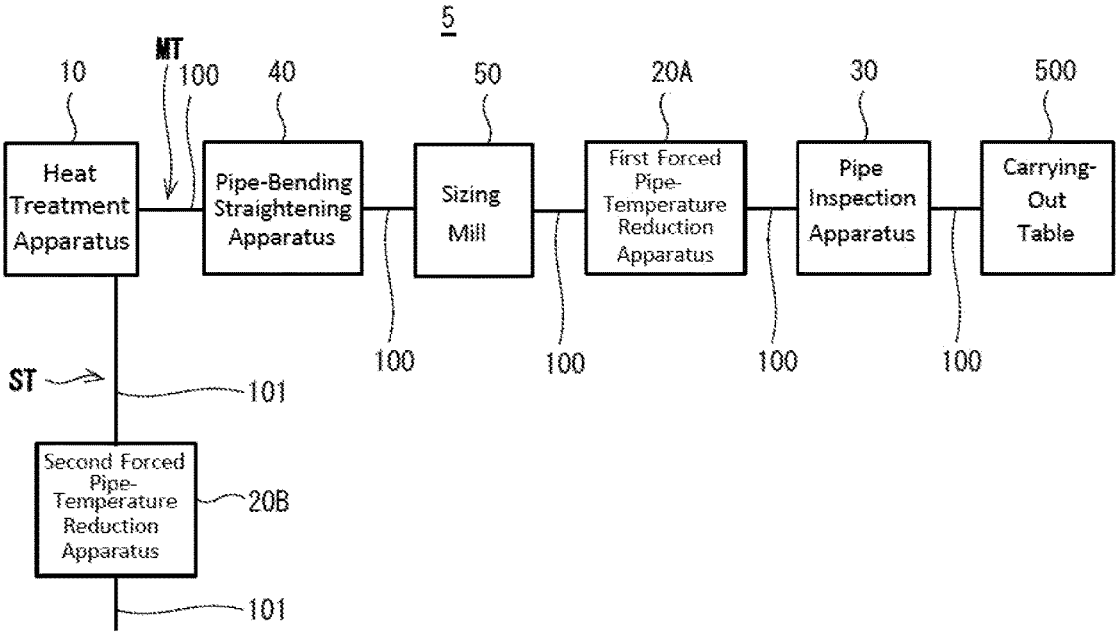
FIG. 6J is a function block diagram showing one example of a facility line of the seamless steel pipe heat-treatment-finishing-treatment continuous facility according to the sixth embodiment which is different from the facility lines shown in FIG. 6A to FIG. 6I.

In the case where the sizing mill 50 is disposed in the seamless steel pipe heat-treatment-finishing-treatment continuous facility 5 shown in FIG. 5B, a pattern shown in FIG. 6I or a pattern shown in FIG. 6J may be considered. In FIG. 6I, the sizing mill 50 is disposed on the main transfer path MT at a position upstream of and adjacent to the steel pipe-bending straightening apparatus 40. In other words, the sizing mill 50 is disposed on the main transfer path MT at a position between the heat treatment apparatus 10 and the steel pipe-bending straightening apparatus 40. In FIG. 6J, the sizing mill 50 is disposed on the main transfer path MT at a position downstream of and adjacent to the steel pipe-bending straightening apparatus 40. In other words, the sizing mill 50 is disposed on the main transfer path MT at a position between the steel pipe-bending straightening apparatus 40 and the first forced steel pipe-temperature reduction apparatus 20A.

With any one of the configurations shown in FIG. 6A to FIG. 6J, the outer diameter of seamless steel pipe can be adjusted by performing drawing and rolling on a seamless steel pipe by the sizing mill 50.

Other Embodiment

The embodiments of the present invention have been described heretofore. However, the above-mentioned embodiments are merely examples for carrying out the present invention. Accordingly, the present invention is not limited to the above-mentioned embodiments, and various modifications of the above-mentioned embodiments are conceivable without departing from the gist of the present invention.

In the seamless steel pipe heat-treatment-finishing-treatment continuous facility according to the above-mentioned embodiments, another finishing facility other than the steel pipe inspection apparatus 30 may be disposed on the main transfer path MT at a position upstream of the steel pipe inspection apparatus 30 and downstream of the first forced steel pipe-temperature reduction apparatus 20A. Another finishing facility may be, for example, a cutting apparatus for cutting a seamless steel pipe with a predetermined length, a chamfering apparatus which chamfers the end face of a seamless steel pipe, or a profile meter which measures the outer diameter, the inner diameter, the wall thickness or the like of a seamless steel pipe. For example, a cutting apparatus may be disposed on the main transfer path MT at a position between the first forced steel pipe-temperature reduction apparatus 20A and the steel pipe inspection apparatus 30. A chamfering apparatus may be disposed on the main transfer path MT at a position between the first forced steel pipe-temperature reduction apparatus 20A and the steel pipe inspection apparatus 30. A profile meter may be disposed on the main transfer path MT at a position between the first forced steel pipe-temperature reduction apparatus 20A and the steel pipe inspection apparatus 30. One or more apparatuses selected from the cutting apparatus, the chamfering apparatus, and the profile meter may be continuously disposed on the main transfer path MT at a position between the first forced steel pipe-temperature reduction apparatus 20A and the steel pipe inspection apparatus 30. Another finishing apparatus other than the cutting apparatus, the chamfering apparatus, and the profile meter may be disposed on the main transfer path MT at a position between the first forced steel pipe-temperature reduction apparatus 20A and the steel pipe inspection apparatus 30.

Finishing facilities may be disposed on the main transfer path MT at a position downstream of the steel pipe inspection apparatus 30 and upstream of the carrying-out table 500. The finishing facilities may be a cutting apparatus which cuts a seamless steel pipe with a predetermined length, a steel pipe leading end correcting apparatus which corrects the leading end portion of a seamless steel pipe, an end face processing apparatus which performs processing on the end face of a seamless steel pipe, and a marking apparatus which performs marking on a seamless steel pipe. These apparatuses may be connected with each other in one row along the main transfer mechanism 100 from the upstream side toward the downstream side of the seamless steel pipe heat-treatment-finishing-treatment continuous facility.

Another facility may be disposed on the main transfer path MT at a position downstream of the heat treatment apparatus 10 and upstream of the first forced steel pipe-temperature reduction apparatus 20A. The facility disposed at a position upstream of the heat treatment apparatus 10 is not particularly limited. Another heat treatment apparatus, such as a quenching apparatus, may be disposed at a position upstream of the heat treatment apparatus 10, or an apparatus forming a pipe-producing line facility (drawing and rolling machine such as a mandrel mill or a sizer) may be disposed at a position upstream of the heat treatment apparatus 10.

Figure 7:
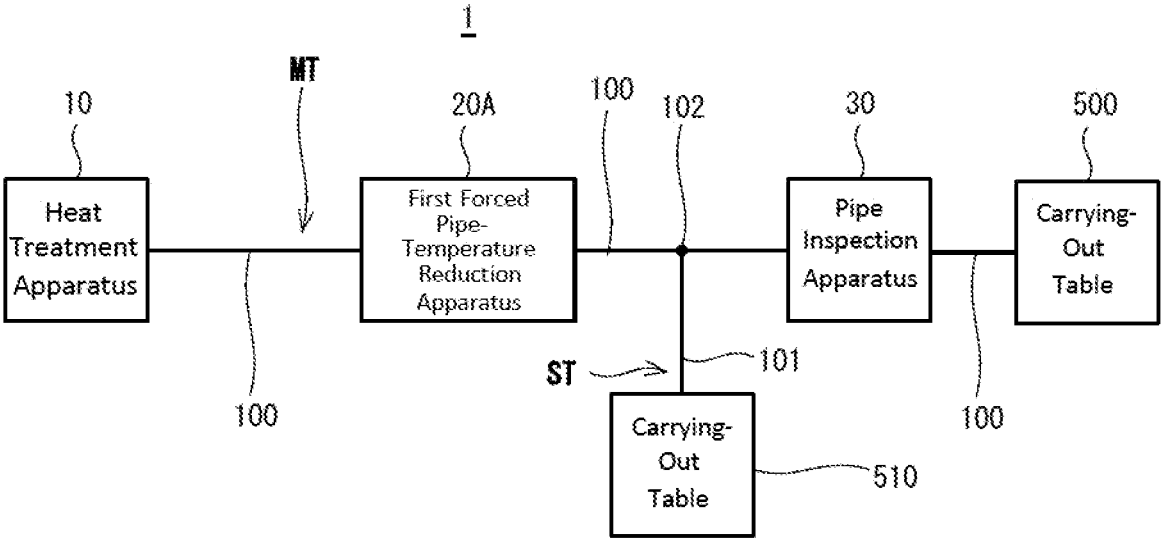
FIG. 7 is a function block diagram showing one example of another facility line of the seamless steel pipe heat-treatment-finishing-treatment continuous facility which is different from the facility lines shown in FIG. 1 to FIG. 6J.

The seamless steel pipe heat-treatment-finishing-treatment continuous facility of the above-mentioned embodiment may be configured such that, as shown in FIG. 7, the sub-transfer mechanism 101 is disposed between the first forced steel pipe-temperature reduction apparatus 20A and the steel pipe inspection apparatus 30, and the carrying-out table 510 is disposed downstream of the sub-transfer mechanism 101. In this case, the sub-transfer path ST which is branched from the main transfer path MT is formed between the first forced steel pipe-temperature reduction apparatus 20A and the steel pipe inspection apparatus 30. For example, a seamless steel pipe which requires no test for surface defects and/or inner defects by the steel pipe inspection apparatus 30 is transferred to the carrying-out table 510 using the sub-transfer mechanism 101. With such a configuration, a seamless steel pipe which requires no test for surface defects and/or inner defects by the steel pipe inspection apparatus 30 can be carried out to another location from the seamless steel pipe heat-treatment-finishing-treatment continuous facility without passing through the steel pipe inspection apparatus 30.

REFERENCE SIGNS LIST

1 to 5 seamless steel pipe heat-treatment-finishing-treatment continuous facility
10 heat treatment apparatus
20A first forced steel pipe-temperature reduction apparatus
20B second forced steel pipe-temperature reduction apparatus
30 steel pipe inspection apparatus
40 steel pipe-bending straightening apparatus
50 sizing mill
100 main transfer mechanism
101 sub-transfer mechanism
102 branch point
500 carrying-out table
510 carrying-out table
MT main transfer path
ST sub-transfer path

The invention claimed is:

1. A seamless steel pipe heat-treatment-finishing-treatment continuous facility comprising:

a heat treatment apparatus configured to allow a seamless steel pipe to be inserted therein, the heat treatment apparatus performing tempering on the seamless steel pipe inserted into the heat treatment apparatus;

a steel pipe inspection apparatus configured to perform a test for a surface defect and/or an inner defect of the seamless steel pipe discharged and transferred from the heat treatment apparatus, the steel pipe inspection apparatus being disposed downstream of the heat treatment apparatus;

a main transfer mechanism forming a main transfer path for transferring the seamless steel pipe, which is discharged from the heat treatment apparatus, to the steel pipe inspection apparatus disposed downstream of the heat treatment apparatus, the main transfer mechanism including a plurality of transfer members for transferring the seamless steel pipe; and a first forced steel pipe-temperature reduction apparatus configured to forcibly reduce a temperature of the seamless steel pipe on the main transfer path, wherein the first forced steel pipe-temperature reduction apparatus reduces the temperature of the seamless steel pipe at a cooling rate higher than a cooling rate of cooling in air, the first forced steel pipe-temperature reduction apparatus being disposed on the main transfer path at a position downstream of the heat treatment apparatus, and upstream of the steel pipe inspection apparatus, wherein the first forced steel pipe-temperature reduction apparatus is, via the main transfer mechanism, connected to the heat treatment apparatus disposed upstream of the first forced steel pipe-temperature reduction apparatus, and the first forced steel pipe-temperature reduction apparatus is, via the main transfer mechanism, also connected to the steel pipe inspection apparatus disposed downstream of the first forced steel pipe-temperature reduction apparatus.

2. The seamless steel pipe heat-treatment-finishing-treatment continuous facility according to claim 1 further comprising a steel pipe-bending straightening apparatus configured to straighten bending in the seamless steel pipe, the steel pipe-bending straightening apparatus being disposed on the main transfer path at a position downstream of the heat treatment apparatus, and upstream of the first forced steel pipe-temperature reduction apparatus.

3. The seamless steel pipe heat-treatment-finishing-treatment continuous facility according to claim 1 further comprising a steel pipe-bending straightening apparatus configured to straighten bending in the seamless steel pipe, the steel pipe-bending straightening apparatus being disposed on the main transfer path at a position downstream of the first forced steel pipe-temperature reduction apparatus, and upstream of the steel pipe inspection apparatus.

4. The seamless steel pipe heat-treatment-finishing-treatment continuous facility according to claim 2 further comprising a second forced steel pipe-temperature reduction apparatus configured to forcibly reduce a temperature of the seamless steel pipe on the main transfer path, the second forced steel pipe-temperature reduction apparatus being disposed on the main transfer path at a position downstream of the heat treatment apparatus, and upstream of the steel pipe-bending straightening apparatus.

5. The seamless steel pipe heat-treatment-finishing-treatment continuous facility according to claim 2 further comprising:

a sub-transfer mechanism disposed at a position downstream of the heat treatment apparatus and upstream of the steel pipe-bending straightening apparatus, connected to the heat treatment apparatus or to the main transfer mechanism, forming a sub-transfer path which is a transfer path different from the main transfer path, and including a plurality of transfer members for transferring the seamless steel pipe; and a second forced steel pipe-temperature reduction apparatus configured to forcibly reduce a temperature of the seamless steel pipe on the sub-transfer path, the second forced steel pipe-temperature reduction apparatus being disposed on the sub-transfer path.

6. The seamless steel pipe heat-treatment-finishing-treatment continuous facility according to claim 5, wherein the sub-transfer mechanism is connected to the main transfer mechanism, and the sub-transfer path is formed by branching from the main transfer path, and the sub-transfer mechanism transfers, through the sub-transfer path, the seamless steel pipe transferred through the main transfer path.

7. The seamless steel pipe heat-treatment-finishing-treatment continuous facility according to claim 5, wherein the sub-transfer mechanism is connected to the heat treatment apparatus, and transfers, through the sub-transfer path, the seamless steel pipe which is discharged from the heat treatment apparatus but which is not transferred to the main transfer path.

8. The seamless steel pipe heat-treatment-finishing-treatment continuous facility according to claim 2 further comprising a sizing mill disposed on the main transfer path at a position upstream or downstream of and adjacent to the steel pipe-bending straightening apparatus.

9. The seamless steel pipe heat-treatment-finishing-treatment continuous facility according to claim 3 further comprising a sizing mill disposed on the main transfer path at a position upstream or downstream of and adjacent to the steel pipe-bending straightening apparatus.

10. The seamless steel pipe heat-treatment-finishing-treatment continuous facility according to claim 4 further comprising a sizing mill disposed on the main transfer path at a position upstream or downstream of and adjacent to the steel pipe-bending straightening apparatus.

11. The seamless steel pipe heat-treatment-finishing-treatment continuous facility according to claim 5 further comprising a sizing mill disposed on the main transfer path at a position upstream or downstream of and adjacent to the steel pipe-bending straightening apparatus.

12. The seamless steel pipe heat-treatment-finishing-treatment continuous facility according to claim 6 further comprising a sizing mill disposed on the main transfer path at a position upstream or downstream of and adjacent to the steel pipe-bending straightening apparatus.

13. The seamless steel pipe heat-treatment-finishing-treatment continuous facility according to claim 7 further comprising a sizing mill disposed on the main transfer path at a position upstream or downstream of and adjacent to the steel pipe-bending straightening apparatus.

* * * * *